US010094197B2

(12) United States Patent
Ward et al.

(10) Patent No.: US 10,094,197 B2
(45) Date of Patent: Oct. 9, 2018

(54) REVERSE CEMENTATION OF LINER STRING FOR FORMATION STIMULATION

(71) Applicant: Weatherford Technology Holdings, LLC, Houston, TX (US)

(72) Inventors: Damian Leonard Ward, Calgary (CA); Jeffrey Lance Orita, Calgary (CA); Randal Brent Biedermann, Calgary (CA); Simon J. Harrall, Houston, TX (US)

(73) Assignee: WEATHERFORD TECHNOLOGY HOLDINGS, Houston, TX (US)

( * ) Notice: Subject to any disclaimer, the term of this patent is extended or adjusted under 35 U.S.C. 154(b) by 570 days.

(21) Appl. No.: 14/797,386

(22) Filed: Jul. 13, 2015

(65) Prior Publication Data

US 2016/0024876 A1 Jan. 28, 2016

Related U.S. Application Data

(60) Provisional application No. 62/028,592, filed on Jul. 24, 2014.

(51) Int. Cl.

| | |
|---|---|
| ***E21B 33/14*** | (2006.01) |
| ***E21B 43/10*** | (2006.01) |
| ***E21B 34/06*** | (2006.01) |

(52) U.S. Cl.

CPC ..... *E21B 33/14* (2013.01); *E21B 34/063* (2013.01); *E21B 43/10* (2013.01); *E21B 43/105* (2013.01)

(58) Field of Classification Search

CPC ..... E21B 33/14; E21B 17/00; E21B 34/063; E21B 33/12; E21B 43/105; E21B 43/10; E21B 34/06; E21B 33/13

USPC ..... 166/207, 208

See application file for complete search history.

(56) References Cited

U.S. PATENT DOCUMENTS

| | | | | |
|---|---|---|---|---|
| 3,253,655 | A | 5/1966 | Brown | |
| 3,260,309 | A | 7/1966 | Brown | |
| 3,346,050 | A | 10/1967 | Brown | |
| 7,108,080 | B2 * | 9/2006 | Tessari | E21B 7/20 175/21 |
| 7,252,152 | B2 | 8/2007 | LoGiudice et al. | |

(Continued)

FOREIGN PATENT DOCUMENTS

| | | | |
|---|---|---|---|
| GB | 1063977 | A | 4/1967 |
| WO | 2014169166 | A2 | 10/2014 |

(Continued)

OTHER PUBLICATIONS

United Kingdom Examination Report dated Feb. 3, 2017, for United Kingdom Patent Application No. GB1700642.0.

(Continued)

*Primary Examiner* — Michael R Wills, III

(74) *Attorney, Agent, or Firm* — Patterson + Sheridan, LLP

(57) ABSTRACT

A method of lining a wellbore having a tubular string cemented therein includes: running a liner string into the wellbore using a workstring having a liner deployment assembly (LDA) latched to the liner string; hanging the liner string from the tubular string and setting a seal of the liner string against the tubular string; opening a crossover valve of the liner string located below the set seal; and pumping cement slurry through the open crossover valve and down an annulus formed between the liner string and the wellbore.

30 Claims, 17 Drawing Sheets

(56) References Cited

U.S. PATENT DOCUMENTS

| | | | | |
|---|---|---|---|---|
| 7,311,148 | B2 | 12/2007 | Giroux et al. | |
| 8,286,717 | B2 | 10/2012 | Giroux et al. | |
| 8,403,078 | B2 | 3/2013 | Brunnert et al. | |
| 2002/0036087 | A1 | 3/2002 | Bixenman et al. | |
| 2004/0084182 | A1 | 5/2004 | Edgar et al. | |
| 2005/0217869 | A1* | 10/2005 | Doane | E21B 23/06 166/387 |
| 2012/0279705 | A1 | 11/2012 | Moffitt | |
| 2013/0264068 | A1* | 10/2013 | Hanson | E21B 21/103 166/373 |
| 2013/0319767 | A1 | 12/2013 | Wilson et al. | |
| 2014/0305662 | A1* | 10/2014 | Giroux | E21B 33/14 166/386 |
| 2014/0352944 | A1* | 12/2014 | Devarajan | E21B 23/02 166/123 |
| 2015/0176367 | A1 | 6/2015 | Hern et al. | |
| 2016/0160603 | A1* | 6/2016 | Sevadjian | E21B 33/14 166/288 |
| 2016/0222756 | A1* | 8/2016 | Perschke | E21B 33/14 |
| 2016/0281459 | A1* | 9/2016 | Stautzenberger | E21B 33/04 |

FOREIGN PATENT DOCUMENTS

| | | | | |
|---|---|---|---|---|
| WO | 2015/038119 | A1 | 3/2015 | |
| WO | 2015038171 | A1 | 3/2015 | |
| WO | 2015088524 | A2 | 6/2015 | |
| WO | WO-2015088524 | A2 * | 6/2015 | E21B 33/04 |

OTHER PUBLICATIONS

Australian Examination Report dated Sep. 1, 2017, for Australian Patent Application No. 2015294454.

PCT International Search Report and Written Opinion dated Dec. 14, 2015 for International Application No. PCT/US2015/039753.

PCT International Preliminary Report on Patentability dated Feb. 2, 2017, for International Application No. PCT/US2015/039753.

Canadian Office Action dated Nov. 22, 2017, for Canadian Patent Application No. 2,954,789.

Australian Examination Report dated Nov. 27, 2017, for Australian Patent Application No. 2015294454.

* cited by examiner

REVERSE CEMENTATION OF LINER STRING FOR FORMATION STIMULATION

BACKGROUND OF THE DISCLOSURE

Field of the Disclosure

The present disclosure generally relates to reverse cementation of a liner string for formation stimulation.

Description of the Related Art

Hydraulic fracturing (aka hydrofracking or fracking) is an operation for stimulating a subterranean formation to increase production of formation fluid, such as crude oil and/or natural gas. A fracturing fluid is pumped into the wellbore to initiate and propagate fractures in the formation, thereby providing flow channels to facilitate movement of the formation fluid into the wellbore. The fracturing fluid is injected into the wellbore under sufficient pressure to penetrate and open the channels in the formation. The fracturing fluid injection also deposits proppant in the open channels to prevent closure of the channels once the injection pressure has been relieved.

In a staged fracturing operation, multiple zones of a formation are isolated sequentially for treatment. To achieve this isolation, a liner string equipped with multiple fracture valves is deployed into the wellbore and set into place. A first zone of the formation may be selectively treated by opening a first of the fracture valves and injecting the fracturing fluid into the first zone. Subsequent zones may then be treated by opening the respective fracture valves. The fracture valves include open hole packers for isolating the zones from each other. The open hole packers are used instead of conventional forward cementation of the liner string to avoid the risk of fouling the fracture valves with cement.

SUMMARY OF THE DISCLOSURE

The present disclosure generally relates to reverse cementation of a liner string for formation stimulation. In one embodiment, a method of lining a wellbore having a tubular string cemented therein includes: running a liner string into the wellbore using a workstring having a liner deployment assembly (LDA) latched to the liner string; hanging the liner string from the tubular string and setting a seal of the liner string against the tubular string; opening a crossover valve of the liner string located below the set seal; and pumping cement slurry through the open crossover valve and down an annulus formed between the liner string and the wellbore.

In another embodiment, a liner string for use in a wellbore includes: a mandrel having a latch profile formed at an upper end thereof for engagement with a running tool; a seal disposed along the mandrel; a setting sleeve linked to the mandrel for engagement with a setting tool to set the seal; a crossover valve for connection to a lower end of the mandrel; and a reverse cementing valve (RCV) for connection to the crossover valve.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1A:
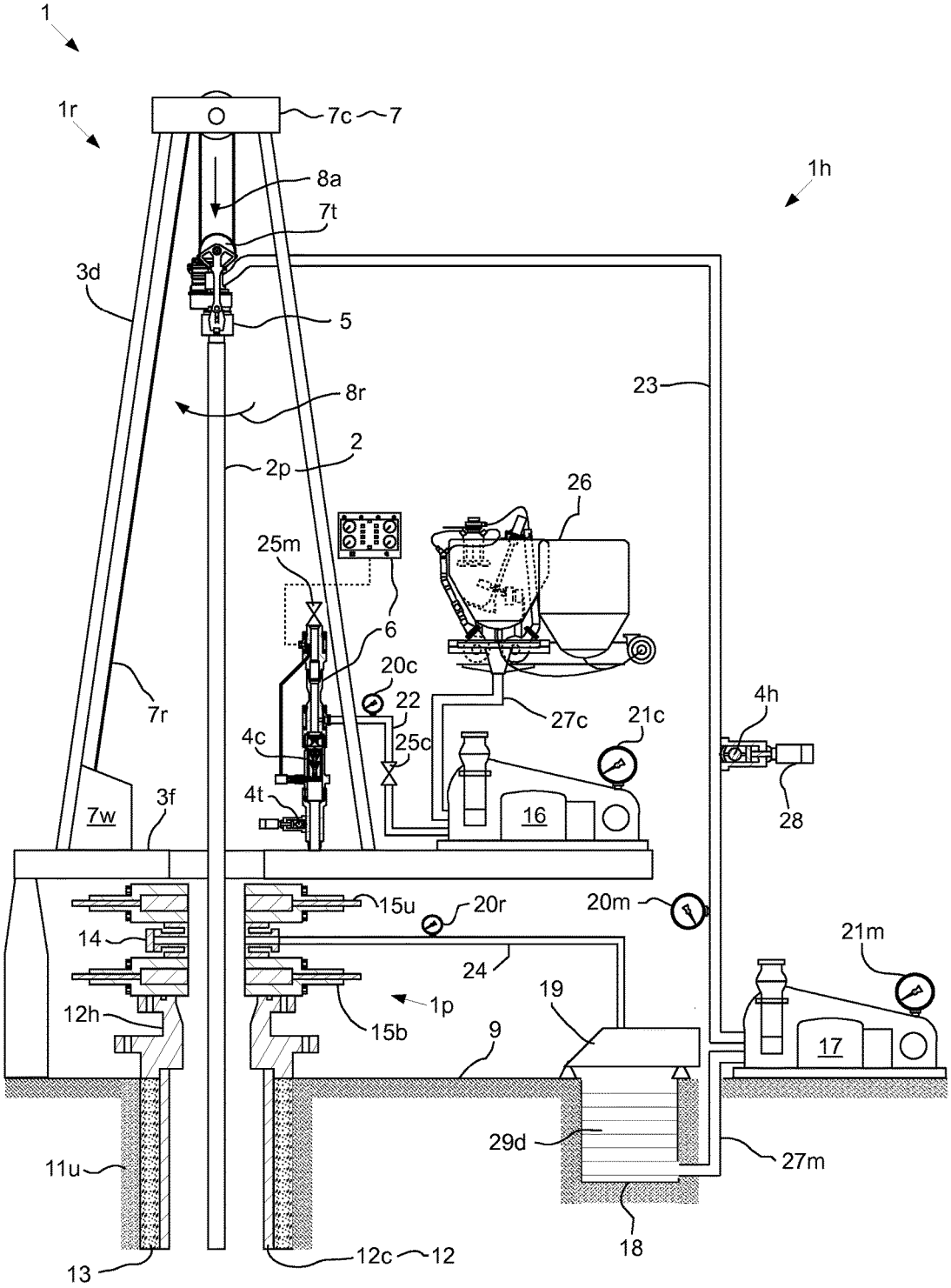
FIGS. 1A-1C illustrate deployment of a liner string into a wellbore using a drilling system having a workstring, according to one embodiment of the present disclosure.
Figures 1B, 1C:
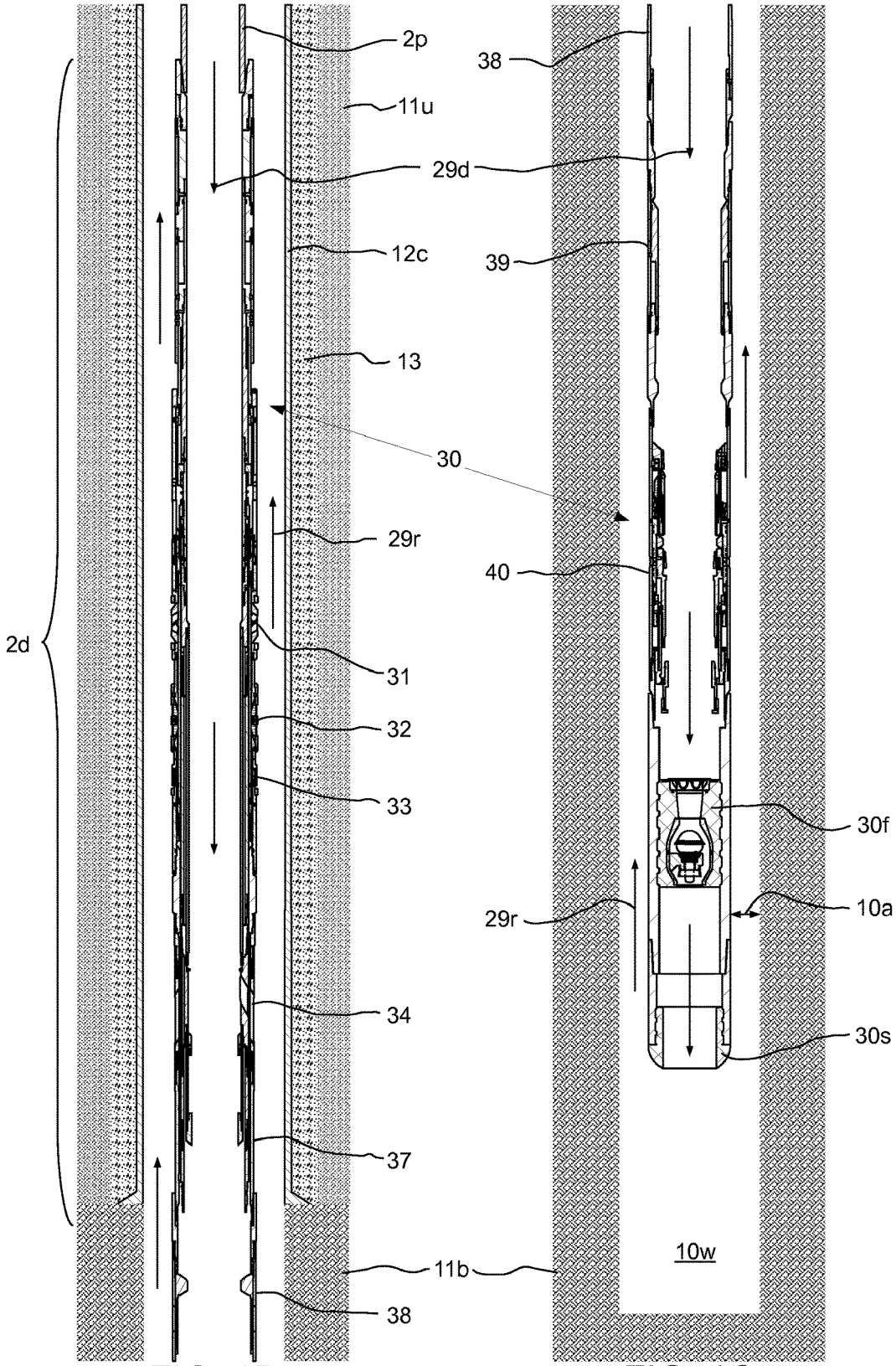
Figures 2A, 2B, 2C, 2D, 2E:
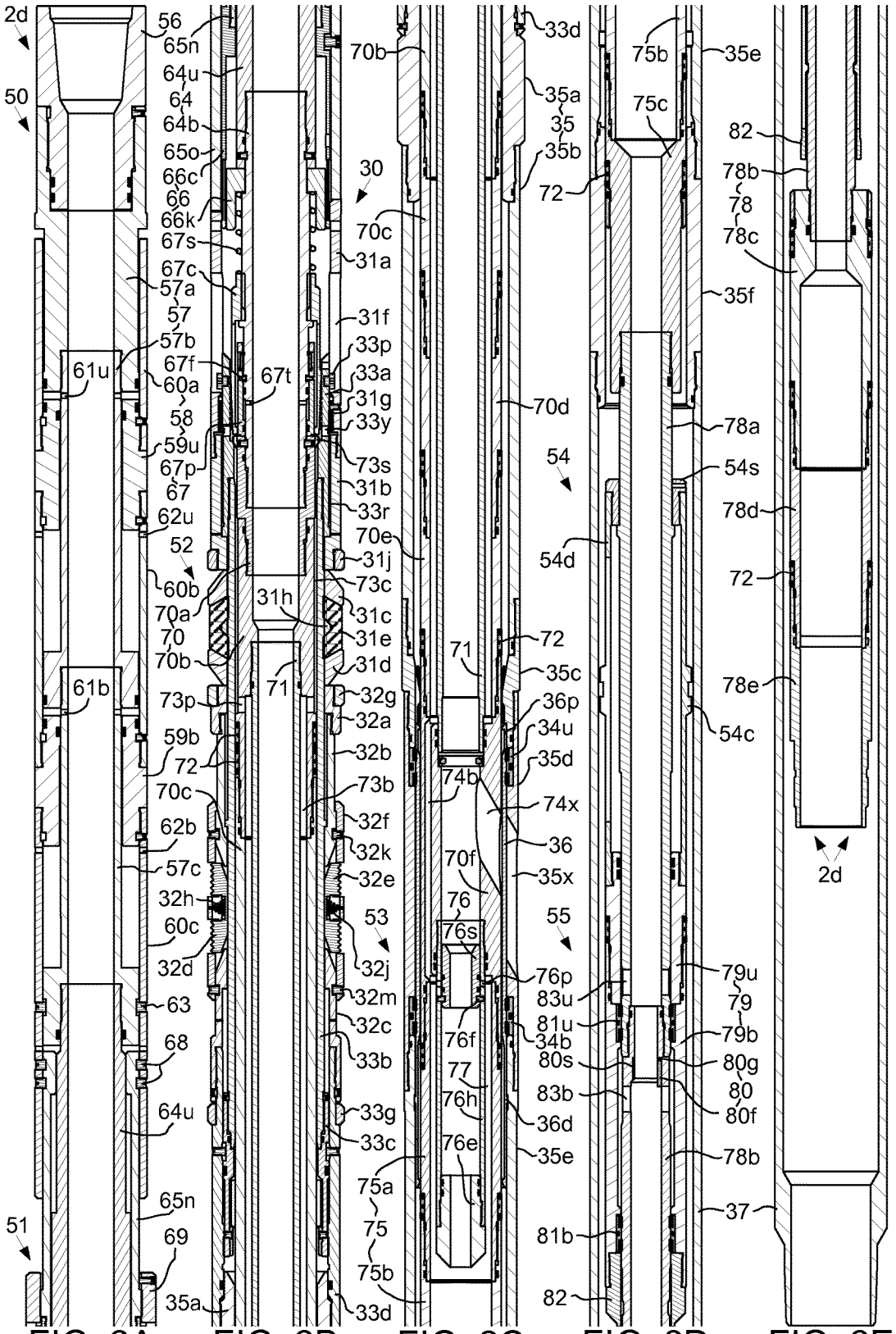
FIGS. 2A-2E illustrate a deployment assembly of the workstring and an upper portion of the liner string.

FIGS. 1A-1C illustrate deployment of a liner string 30 into a wellbore 10*w* using a drilling system 1 having a workstring 2, according to one embodiment of the present disclosure. The drilling system 1 may include a drilling rig 1*r*, a fluid handling system 1*h*, a blowout preventer (BOP) stack 1*p*, and the workstring 2.

The drilling rig 1*r* may include a derrick 3*d*, a floor 3*f*, a rotary table (not shown), a spider (not shown), a top drive 5, a cementing head 6, and a hoist 7. The top drive 5 may include a motor for rotating 8*r* the workstring 2. The top drive motor may be electric or hydraulic. A frame of the top drive 5 may be linked to a rail (not shown) of the derrick 3*d* for preventing rotation thereof during rotation 8*r* of the workstring 2 and allowing for vertical movement of the top drive with a traveling block 7*t* of the hoist 7. The quill may be torsionally driven by the top drive motor and supported from the frame by bearings. The top drive 5 may further have an inlet connected to the frame and in fluid communication with the quill. The traveling block 7*t* may be supported by wire rope 7*r* connected at its upper end to a crown block 7*c*. The wire rope 7*r* may be woven through sheaves of the blocks 7*c,t* and extend to drawworks 7*w* for reeling thereof, thereby raising or lowering the traveling block 7*t* relative to the derrick 3*d*.

Alternatively, a Kelly and rotary table may be used instead of the top drive 5.

A vertical wellbore 10*w* may have already been drilled from a surface 9 of the earth into an upper formation 11*u* and a casing string 12 may have been deployed into the wellbore. The casing string 12 may include a wellhead 12*h* and joints of casing 12*c* connected together, such as by threaded couplings. The casing string 12 may have been cemented 13 into the wellbore 10*w*. The casing string 12 may extend to a depth adjacent a bottom of the upper formation 11*u*. The wellbore 10*w* may then be extended into a lower formation 11*b* using a drill string (not shown). The upper formation 11*u* may be non-productive and the lower formation 11*b* may be hydrocarbon-bearing. The BOP stack 1*p* may be connected to the wellhead 12*h*. The BOP stack 1*p* may include a flow cross 14 and one or more BOPS 15*u,b*.

Alternatively, a lower portion of the wellbore 10*w* may be deviated, such as slanted or horizontal.

Figures 9A, 9B, 9C, 9D, 9E:
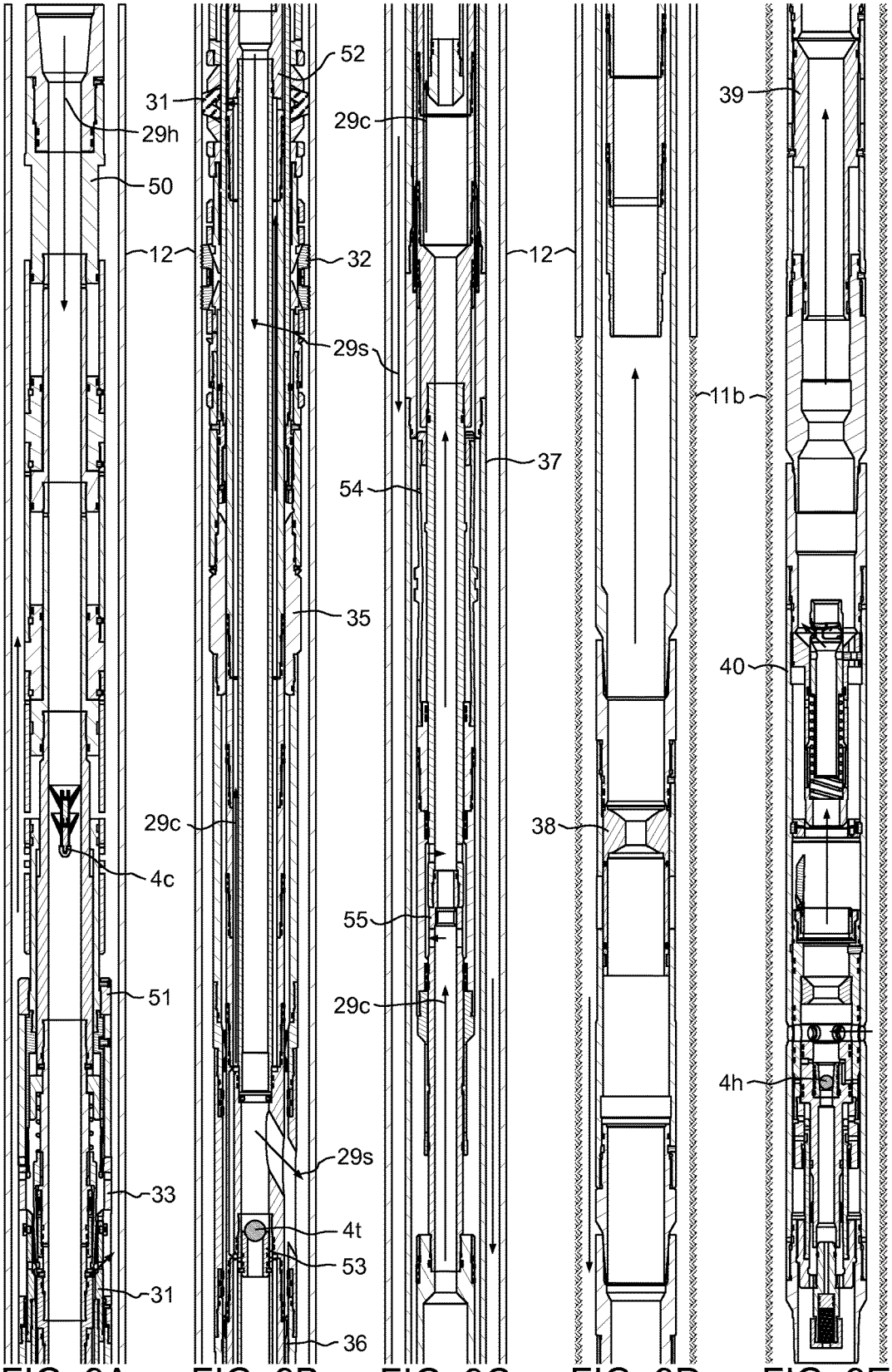
FIGS. 9A-9E illustrate reverse cementing of the liner string.

The fluid handling system 1*h* may include one or more pumps, such as a cement pump 16, a mud pump 17, a reservoir, such as a pit 18 or tank (not shown), a solids separator, such as a shale shaker 19, one or more pressure gauges 20*c,m,r*, one or more stroke counters 21*c,m*, one or more flow lines, such as cement line 22, mud line 23, and return line 24, one or more shutoff valves 25*c,m*, a cement mixer 26, one or more feed lines 27*c,m*, and a launcher 28. When the drilling system 1 is in a drilling mode (not shown) and the deployment mode, the pit 18 may be filled with drilling fluid 29*d*. In the cementing mode, the pit 18 may be filled with chaser fluid 29*h* (FIG. 9A).

A first end of the return line 24 may be connected to an outlet of the flow cross 14 and a second end of the return line may be connected to an inlet of the shaker 19. The returns pressure gauge 20*r* may be assembled as part of the return line 24. A lower end of the mud line 23 may be connected to an outlet of the mud pump 17 and an upper end of the mud line may be connected to the top drive inlet. The mud pressure gauge 20*m* and launcher 28 may be assembled as part of the mud line 23. A shifting plug 4*h*, such as a ball, may be loaded into the launcher 28. An upper end of the cement line 22 may be connected to the cementing head 6 and a lower end of the cement line may be connected to an outlet of the cement pump 16. The cement shutoff valve 25*c* and the cement pressure gauge 20*c* may be assembled as part of the cement line 22. A lower end of the mud feed line 27*m* may be connected to an outlet of the pit 18 and an upper end of the mud feed line may be connected to an inlet of the mud pump 17. An upper end of the cement feed line 27*c* may be connected to an outlet of the cement mixer 26 and a lower end of the cement feed line may be connected to an inlet of the cement pump 16.

The cementing head 6 may include the shutoff valve 25*m*, an actuator swivel, a cementing swivel, a cementing plug launcher, a control console, and a setting plug launcher. A setting plug 4*t* may be loaded into the setting plug launcher. A cementing plug 4*c*, such as a dart, may be loaded into the cementing plug launcher. In the deployment mode, the cementing head 6 may be in a standby position. To shift the drilling system 1 into a cementing mode, the workstring 2 may be disconnected from the top drive 5 and the cementing head 6 may be inserted and connected between the top drive 5 and the workstring 2 by connecting the shutoff valve 25*m* to the quill and connecting the setting plug launcher to the top of the workstring 2.

Alternatively, the swivels may be omitted from the cementing head 6.

When the drilling system 1 is in the deployment mode, an upper end of the workstring 2 may be connected to the top drive quill, such as by threaded couplings. The workstring 2 may include a liner deployment assembly (LDA) 2*d* and a work stem 2*p*, such as joints of drill pipe connected together by threaded couplings. An upper end of the LDA 2*d* may be connected a lower end of the work stem 2*p*, such as by threaded couplings. The LDA 2*d* may also be releasably longitudinally and torsionally connected to the liner string 30.

Alternatively, the work stem 2*p* may be coiled tubing instead of drill pipe.

The liner string 30 may include a packer 31, a liner hanger 32, a mandrel 33, a crossover valve 34, an adapter 37, joints of liner (not shown), a fracture valve 38, a toe sleeve 39, a reverse cementing valve (RCV) 40, a float collar 30*f*, and the reamer shoe 30*s*. The mandrel 33, liner joints, float collar 30*f*, fracture valve 38, toe sleeve 39, RCV 40, float collar 30*f*, and reamer shoe 30*s* may be interconnected, such as by threaded couplings. The float collar 30*f* may include a housing, a check valve, and a body. The body and check valve may be made from drillable materials. The check valve may include a seat, a poppet disposed within the seat, a seal disposed around the poppet and adapted to contact an inner surface of the seat to close the body bore, and a rib. The poppet may have a head portion and a stem portion. The rib may support a stem portion of the poppet. A spring may be disposed around the stem portion and may bias the poppet against the seat to facilitate sealing. During deployment of the liner string 30, the drilling fluid 29*d* may be pumped down at a sufficient pressure to overcome the bias of the spring, actuating the poppet downward to allow drilling fluid to flow through the bore of the body and into the annulus 10*a* (via the reamer shoe 30*s*).

Alternatively, the liner string 30 may include a plurality of fracture valves 38, each for a respective zone of the lower formation 11*b* to be stimulated. The plurality of fracture valves 38 may be greater than or equal to five, ten, twenty, thirty, forty, or more.

During deployment of the liner string 30, the workstring 2 may be lowered 8*a* by the traveling block 7*t* and rotated 8*r* by the top drive 5. The drilling fluid 29*d* may be pumped into the workstring bore by the mud pump 17 via the mud line 23 and top drive 5. The drilling fluid may flow down the workstring bore and the liner string bore and be discharged by a reamer shoe 30*s* into an annulus 10*a* formed between the liner string 30/workstring 2 and the wellbore 10*w*/casing string 12. The returning drilling fluid 29*r* (including any cuttings made by the reamer shoe 30*s*) may flow up the annulus 10*a* and enter the return line 24 via an annulus of the BOP stack 1*p*. The returning drilling fluid 29*r* may flow through the return line 24 and into the shale shaker inlet. The returning drilling fluid 29*r* may be processed by the shale shaker 19 to remove any cuttings therefrom. The workstring 9 may be lowered until the liner string 30 reaches a desired deployment depth, such as an upper portion of the liner string 30 being located adjacent to a lower portion of the casing string 12.

FIGS. 2A-2E illustrate the LDA 2*d* and an upper portion of the liner string 30. The LDA 2*d* may include a setting tool 50, a running tool 51, a crossover sub 52, a catcher 53, a shifting tool 54, and a traveling valve 55. The setting tool 50 may include an adapter 56, a mandrel 57, and a hydraulic actuator 58. The adapter 56 may be a tubular and have threaded couplings formed at each longitudinal end thereof. The upper threaded coupling may connect the LDA 2*d* to the work stem 2*p*. The mandrel 57 may be tubular and have threaded couplings formed at each longitudinal end thereof. The mandrel 57 may include two or more sections 57*a-c* interconnected, such as by threaded couplings. Engagement of the upper threaded coupling of the mandrel 57 and the lower threaded coupling of the adapter 56 may longitudinally and torsionally connect the mandrel and the adapter and the adapter may carry one or more seals for isolating a bore of the LDA 2*d* from the annulus 10*a*. A fastener, such as a set screw, may secure the threaded connection between the adapter 56 and the mandrel 57.

The hydraulic actuator 58 may include one or more: pistons 59*u,b*, chambers, sleeves 60*a-c*, inlets 61*u,b*, and outlets 62*u,b*. The pistons 59*u,b* may each be annular and have threaded couplings formed at longitudinal ends thereof. Engagement of the upper threaded coupling of each piston 59*u,b* and a lower threaded coupling of the respective sleeve 60*a,b* may longitudinally and torsionally connect the pistons and the sleeves and the pistons may carry outer seals for isolating respective chambers from the annulus 10*a*. Engagement of the lower threaded coupling of each piston 59*u,b* and an upper threaded coupling of the respective sleeve 60*b,c* may longitudinally and torsionally connect the pistons and the sleeves. Fasteners, such as set screws, may secure the threaded connections between the pistons 59*u,b* and the sleeves 60*a-c*.

An upper setting chamber may be formed radially between the mid mandrel section 57*b* and the upper sleeve 60*a* and longitudinally between a lower face of the upper mandrel section 57*a* and an upper face of the upper piston 59*u*. The upper inlets 61*u* may be formed through a wall of the mid mandrel section 57*b* and may provide fluid communication between the LDA bore and the upper setting chamber. The upper mandrel section 57*a* may carry a seal for isolating the upper setting chamber from the annulus 10*a* and the upper piston 59*u* may carry an inner seal for isolating the upper setting chamber from an upper vent chamber. The upper vent chamber may be formed radially between the mid mandrel section 57*b* and the mid sleeve 60*b* and longitudinally between a lower face of the upper piston 59*u* and an upper face of a shoulder of mid mandrel section 57*b*. The upper outlets 62*u* may be formed through a wall of the mid sleeve 60*b* and may provide fluid communication between the upper vent chamber and the annulus 10*a*.

A lower setting chamber may be formed radially between the lower mandrel section 57*c* and the mid sleeve 60*b* and longitudinally between a lower face of the mid mandrel section 57*b* and an upper face of the lower piston 59*b*. The lower inlets 61*b* may be formed through a wall of the lower mandrel section 57*c* and may provide fluid communication between the LDA bore and the lower setting chamber. The mid mandrel section 57*b* may carry a seal for isolating the lower setting chamber from the annulus 10*a* and the lower piston 59*b* may carry an inner seal for isolating the lower setting chamber from a lower vent chamber. The lower vent chamber may be formed radially between the lower mandrel section 57*c* and the lower sleeve 60*c* and longitudinally between a lower face of the lower piston 59*b* and an upper face of a shoulder of lower mandrel section 57*c*. The lower outlets 62*b* may be formed through a wall of the lower sleeve 60*c* and may provide fluid communication between the lower vent chamber and the annulus 10*a*.

The hydraulic actuator 58 may be deactivated by being releasably connected to the mandrel 57 by one or more shearable fasteners 63. The shearable fasteners 63 may be shear screws, each received in a respective threaded socket formed through a wall of the lower sleeve 60*c* and extending into a respective indention formed in an outer surface of the lower mandrel section 57*c*, thereby longitudinally and torsionally connecting the hydraulic actuator 58 to the mandrel 57. The hydraulic actuator 58 may be activated by an activation differential between a higher pressure in the LDA bore and lower pressure in the annulus 10*a*. Once the activation pressure has been achieved, the fasteners 63 may fracture, thereby releasing the actuator 58 from the mandrel 57.

The running tool 51 may include a mandrel 64, one or more sleeves 65*n,o*, and one or more latches 66, 67. The mandrel 64 may be tubular and have threaded couplings formed at each longitudinal end thereof. Engagement of the upper threaded coupling of the running mandrel 64 and the lower threaded coupling of the setting mandrel 57 may longitudinally and torsionally connect the two mandrels and the lower setting mandrel section 57*c* may carry a seal for isolating the LDA bore from the annulus 10*a*. The mandrel 64 may include two or more sections 64*u,b* interconnected, such as by threaded couplings. A fastener, such as a set screw, may secure the threaded connection between the running mandrel sections 64*u,b* and the upper mandrel section 64*u* may carry a seal for isolating the LDA bore from the annulus 10*a*.

The inner running sleeve 65*n* may be releasably connected to the lower setting sleeve 60*c* by a slip joint. The slip joint may include one or more shearable fasteners 68 and a gap formed between a lower face of the lower setting sleeve 60*c* and an upper face of a retainer 69. The shearable fasteners 68 may be shear screws, each received in a respective threaded socket formed through a wall of the lower setting sleeve 60*c* and extending into a respective indention formed in an outer surface of the inner running sleeve 65*n*, thereby longitudinally and torsionally connecting the sleeves. The slip joint may be released by a release differential between a higher pressure in the LDA bore and lower pressure in the annulus 10*a*. Once the release pressure has been achieved, the fasteners 68 may fracture, thereby releasing the inner running sleeve from the lower setting sleeve. The release pressure may be selected to prevent oversetting of the packer 31.

The retainer 69 may be a nut engaged with an outer threaded coupling formed at a lower end of the inner sleeve 64*n*, thereby longitudinally and torsionally connecting the retainer and the inner sleeve. A fastener, such as a set screw, may secure the threaded connection between the retainer 69 and the inner sleeve 64*n*. An upper face of the outer sleeve 64*o* may be located adjacent to a lower face of the retainer 69 and the outer sleeve 64*o* may have part of a torsional coupling, such as a castellation, formed in a lower end thereof and engaged with a mating torsional coupling of the packer 31.

The upper latch 66 may include a fastener, such as a collet 66*c*, and a lock ring 66*k*. The collet 66*c* may have a solid upper base portion and split fingers extending from the base portion to a lower end thereof. Each collet finger may have a lug formed at a lower end thereof engaged with a latch groove of the packer 31, thereby fastening the actuator 58 to the packer. The collet fingers may be cantilevered from the base portion and have a stiffness urging the lugs toward a disengaged position from the packer latch groove. The collet fingers may be forced into engagement with the packer latch groove by entrapment against an outer surface of the lock ring 66*k*.

The collet base portion may have a threaded coupling formed at an upper end thereof engaged with an inner threaded coupling formed at a lower end of the inner sleeve 65*n*, thereby longitudinally and torsionally connecting the collet 66*c* and the inner sleeve. The collet base portion may also be longitudinally and torsionally connected to the outer sleeve 65*o* by a fastener. The fastener may be a screw received in a threaded socket formed through a wall of the outer sleeve 65*o* and extending into a respective indention formed in an outer surface of the collet base portion. The lock ring 66*k* may be entrapped between a lower face of the upper mandrel section 64*u* and a torsion profile, such as splines and splineways, formed in an outer surface of the lower mandrel section 64*b*.

The lower latch 67 may include a compression spring 67*s*, a fastener, such as a collet 67*c*, and a lock piston 67*p*. The collet 67*c* may have a solid upper base portion and split fingers extending from the base portion to a lower end thereof. Each collet finger may have teeth formed in an outer surface thereof engaged with latch teeth of the liner mandrel 33, thereby fastening the running tool mandrel 64 to the liner mandrel. The collet fingers may be cantilevered from the base portion and have a stiffness urging the teeth toward a disengaged position from the liner mandrel teeth. The collet fingers may be forced into engagement with the liner mandrel teeth by entrapment against an outer surface of the lock piston 67*p*.

The compression spring 67*s* may be entrapped between a lower face of a shoulder formed in an inner surface of the lock ring 66*k* and an upper face of a the collet base portion. The collet base portion may be entrapped between the compression spring 67*s* and a lug formed in an outer surface of the lower running mandrel section 64*b*, thereby biasing a lower face of a shoulder formed in an inner surface of the collet base portion into engagement with the lower mandrel section lug. The collet base portion may have a torsion profile formed in an inner surface thereof mated with the torsion profile of the lower mandrel section 64*b*, thereby torsionally connecting the collet base portion and the running mandrel 64 while allowing longitudinal movement of the collet base portion relative to the mandrel 64.

The lock piston 67*p* may be releasably connected to the lower mandrel section 64*b*, such as by one or more shearable fasteners 67*f*. The shearable fasteners 67*f* may be shear screws, each received in a respective threaded socket formed through a wall of the lock piston 67*p* and extending into a respective groove formed in an outer surface of the lower mandrel section 64*b*, thereby restraining the lock piston in a position engaged with the collet fingers. A release chamber may be formed between the lock piston 67*p* and the mandrel 64 and each member may carry a seal for isolating the chamber from the annulus 10*a*. One or more ports 67*t* may be formed through a wall of the lower mandrel section 64*b* for providing fluid communication between the release chamber and the LDA bore. The lock piston 67*p* may be released by a release differential between a higher pressure in the LDA bore and lower pressure in the annulus 10*a*. Once the release pressure has been achieved, the fasteners 67*f* may fracture, thereby releasing the lock piston 67*p* from the mandrel 64. The release pressure may be selected to be greater than the activation pressure of the actuator 58 and the release pressure of the slip joint.

The crossover sub 52 may include a mandrel 70, a wash tube 71, and one or more packoffs 72. The mandrel 70 may be tubular and have threaded couplings formed at each longitudinal end thereof. The mandrel 70 may include two or more sections 70*a-f* interconnected, such as by threaded couplings. Each intermediate mandrel section 70*b-e* and the lower mandrel section 70*f* may carry a seal adjacent to the upper threaded coupling thereof for isolating the threaded connection with the adjacent mandrel section from the annulus 10*a*. Each intermediate mandrel section 70*b-e* may have a shoulder formed in an outer surface thereof adjacent to the lower threaded coupling thereof and the shoulder may trap one or more of the packoffs 72 between an upper face of the adjacent mandrel section.

Each packoff 72 may include a gland, an inner seal, and one or more (two shown) outer seals. The gland may have a recess formed in an outer surface thereof for receiving each outer seal. Each outer seal may engage an inner surface of the liner mandrel 33 and/or an upper seal tube 35*a* of the crossover valve when the respective packoff 72 is aligned with the respective liner member. The inner seal may be carried in a groove formed in an inner surface of the gland to isolate an interface formed between the gland and the mandrel 70.

Engagement of the upper threaded coupling of the crossover mandrel 70 and the lower threaded coupling of the running mandrel 64 may longitudinally and torsionally connect the two mandrels and the upper crossover mandrel section 70*a* may carry a seal for isolating the LDA bore from the annulus 10*a*. A fastener, such as a set screw, may secure the threaded connection between the running mandrel 64 and the crossover mandrel 70.

The wash tube 71 may have a threaded coupling formed at an upper longitudinal end thereof and a stab profile formed at a lower longitudinal end thereof. The second mandrel section 70*b* may have a threaded coupling formed in an inner surface thereof at a mid portion thereof. The lower mandrel section 70*f* may have a receptacle formed in an inner surface thereof at an upper portion thereof and the receptacle may carry one or more seals. Engagement of the upper threaded coupling of the wash tube 71 and the inner threaded coupling of the second mandrel section 70*b* may longitudinally and torsionally connect the two members and the wash tube 71 may carry a seal for isolating the LDA bore from the annulus 10*a*. Engagement of the stab profile of the wash tube 71 with the receptacle seals of the lower mandrel section 70*f* may isolate the LDA bore from the annulus 10*a*.

A bypass passage 73*b* may be formed between the wash tube 71 and the mandrel 70. One or more bypass ports 73*p* may be formed through a wall of the second mandrel section 70*b* above the packoffs 72 carried thereby. The upper mandrel section 70*a* may have a slotted shoulder 73*s* formed in an outer surface thereof for landing on a shoulder formed in an inner surface of the liner mandrel 33. The upper mandrel section 70*a* (except for the slotted shoulder 73*s*) and a portion of the second mandrel section 70*b* above the packoffs 72 carried thereby may have an outer diameter less than an inner diameter of the liner mandrel 33, thereby forming a bypass clearance 71*c* therebetween. The bypass ports 73*p* may provide fluid communication between the bypass passage 73*b* and the annulus 10*a* via the bypass clearance 73*c*, the slotted shoulder 73*s*, and one or more bypass ports 33*y* formed through a wall of the liner mandrel 33.

The lower mandrel section 70*f* may have a longitudinal bypass passage 74*b* formed through and along a wall thereof and a crossover port 74*x* formed through the wall thereof. The bypass passage 74*b* may be in fluid communication with the bypass passage 73*b* and the crossover port 74*x* may be in fluid communication with the LDA bore.

The catcher 53 may include a mandrel 75 and a seat valve 76. The mandrel 75 may be tubular and have threaded couplings formed at each longitudinal end thereof. The mandrel 75 may include two or more sections 75*a-c* interconnected, such as by threaded couplings. The mid 75*b* and lower 75*c* mandrel sections may each carry a seal adjacent to the upper threaded coupling thereof for isolating the threaded connection with the adjacent mandrel section from the annulus 10*a*. The upper 75*a* and mid 75*b* mandrel sections may each have a shoulder formed in an outer surface thereof adjacent to the upper and/or lower threaded coupling thereof and the shoulder may trap one or more of the packoffs 72 between a corresponding upper and/or lower face of the adjacent mandrel section.

The lower mandrel section 75*c* may have a shoulder formed in an outer surface thereof adjacent to the upper threaded coupling thereof and the shoulder may trap one of the packoffs 72 between a retainer, such as a nut, connected thereto, such as by threaded couplings secured by a fastener. The packoff outer seals may engage an inner surface of a lower seal tube 35*f* of the crossover valve 34 when the respective packoff 72 is aligned therewith. Engagement of the upper threaded coupling of the catcher mandrel 75 and the lower threaded coupling of the crossover mandrel 70 may longitudinally and torsionally connect the two mandrels and the lower crossover mandrel section 70*f* may carry a seal for isolating the LDA bore from the annulus 10*a*.

The seat valve 76 may include a housing 76*h*, a seat 76*s*, and a shoe 76*e*. The housing 76*h* may have a threaded coupling formed at each longitudinal end thereof. The lower crossover mandrel section 70*f* may have a threaded coupling formed in an inner surface thereof at a lower portion thereof. Engagement of the upper threaded coupling of the housing 76*h* and the inner threaded coupling of the lower crossover mandrel section 70*f* may longitudinally and torsionally connect the two members and the lower crossover mandrel section 70*f* may carry one or more seals for isolating the LDA bore from the bypass passage 74*b* thereof. Engagement of the lower threaded coupling of the housing 76*h* and a threaded coupling of the shoe 76*e* may longitudinally and torsionally connect the two members and the shoe 76*e* may carry one or more seals for isolating the LDA bore from a bypass passage 77 formed between the seat valve 76 and the mandrel 75. The bypass passage 77 may be in fluid communication with the bypass passage 74*b*.

Figures 10A, 10B, 10C, 10D, 10E:
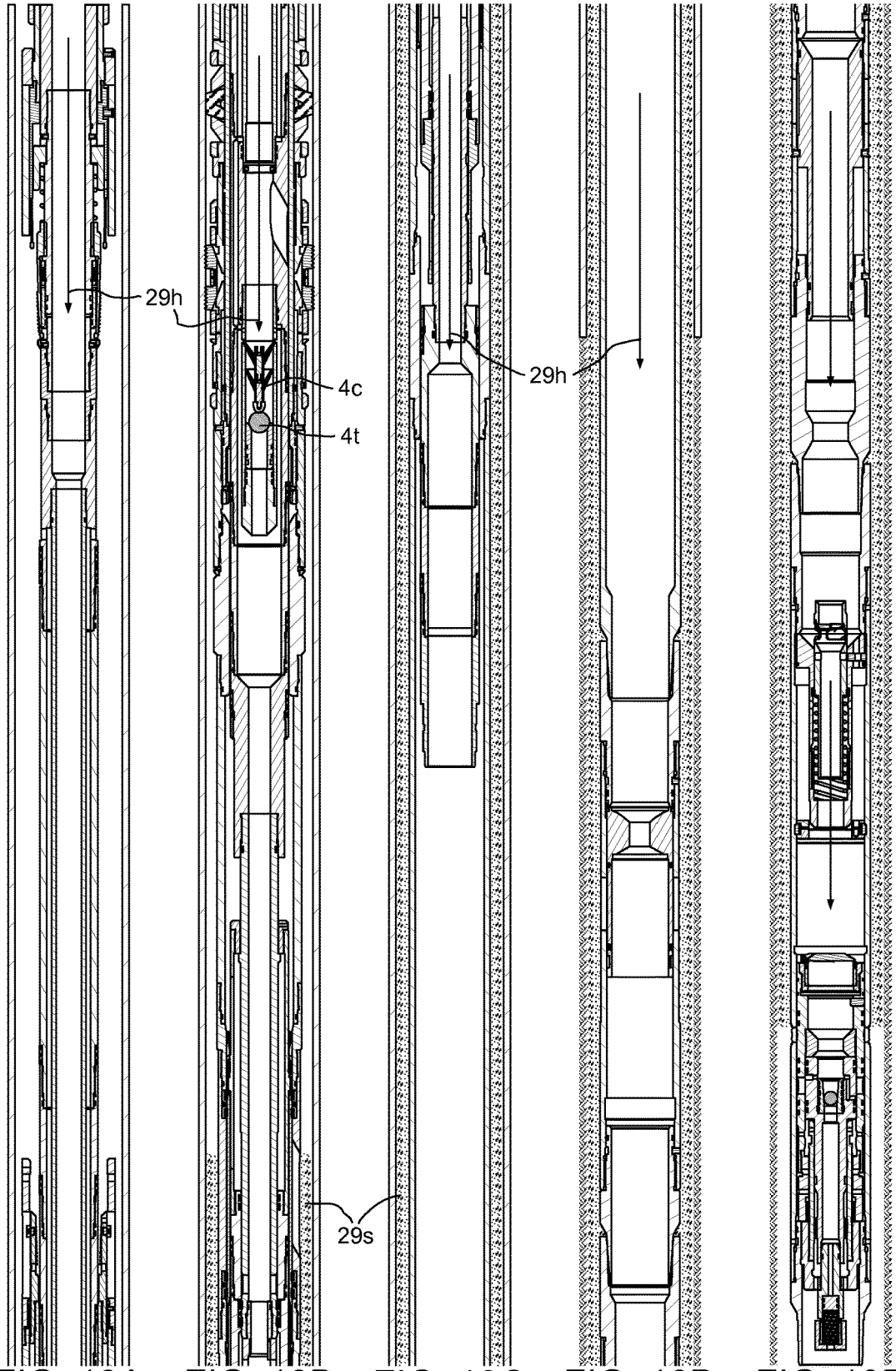
FIGS. 10A-10E illustrate closing of the crossover sleeve and the RCV.

The seat valve 76 may divide the LDA bore into an upper portion and a lower portion. The bypass passage 77 may be in fluid communication with the LDA bore lower portion. The seat 76*s* may be disposed in the housing 76*h* and longitudinally movable relative thereto between closed position (shown) and an open position (FIG. 10B). In the closed position, the seat 76*s* may be releasably connected to the housing 76*h*, such as by one or more (pair shown) shearable fasteners 76*f*. The shearable fasteners 76*f* may be shear screws, each received in a respective threaded socket formed through a wall of the housing 76*h* and extending into a respective indention formed in an outer surface of the seat 76*s*, thereby longitudinally and torsionally connecting the seat and the housing. The shearable fasteners 76*f* may each be operable to fracture in response an opening differential between a higher pressure in the LDA upper portion and a lower pressure in the LDA lower portion, thereby releasing the seat 76*s* from the housing 76*h*.

The housing 76*h* may have one or more (pair shown) valve ports 76*p* formed through a wall thereof. An outer surface of the seat 76*s* may cover the valve ports 76*p* and the seat may carry a pair of seals straddling the valve ports in the closed position. When opening, the seat 76*s* may move downward relative to the housing 76*h* and into engagement with an upper face of the shoe 76*e*, thereby exposing the valve ports 76*p* and providing fluid communication between the LDA bore portions via the bypass passage 77.

The shifting tool 54 may open and close the liner crossover valve 34 and also serve as a mechanical actuator for the traveling valve 55 and include a slider 54*s* and a driver 54*d*. The traveling valve 55 may further include a mandrel 78, a housing 79, a check valve 80, a pair of sliding seals 81*u,b*, a detent 82, and one or more packoffs 72.

The mandrel 78 may be tubular and have threaded couplings formed at each longitudinal end thereof. The mandrel 78 may include two or more sections 78*a-e* interconnected, such as by threaded couplings. Engagement of the upper threaded coupling of the valve mandrel 78 and the lower threaded coupling of the catcher mandrel 75 may longitudinally and torsionally connect the two mandrels and the upper valve mandrel section 78*a* may carry a seal for isolating the LDA bore from the annulus 10*a*. The intermediate 78*b-d* and lower 75*e* mandrel sections may each carry a seal adjacent to the upper threaded coupling thereof for isolating the threaded connection with the adjacent mandrel section from the annulus 10*a*.

One or more 78*c,d* of the intermediate mandrel sections 78*b-d* may each have a shoulder formed in an outer surface thereof adjacent to the lower threaded coupling thereof and the shoulder may trap one or more of the packoffs 72 between a corresponding upper face of the adjacent mandrel section. One 78*c* of the intermediate mandrel sections 78*b-d* may have a shoulder formed in an outer surface thereof adjacent to the upper threaded coupling thereof and the shoulder may trap one of the packoffs 72 between a retainer, such as a nut, connected thereto, such as by a threaded couplings secured by a fastener. The packoff outer seals may engage an inner surface of lower seal tube 35*f* when the respective packoff 72 is aligned therewith.

Figure 11A:
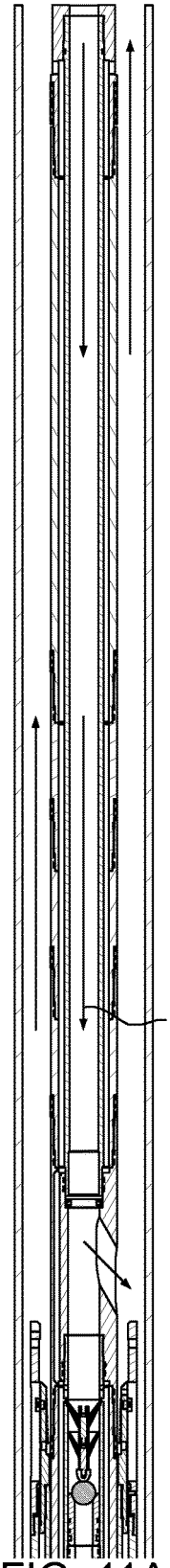
FIGS. 11A-11E illustrate retrieval of the workstring from the wellbore.
Figure 11B:
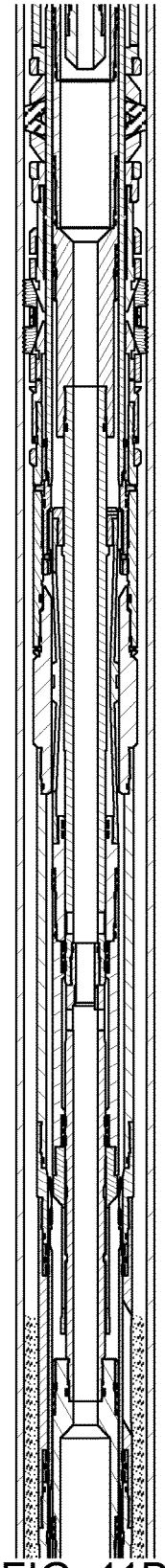
Figure 11C:
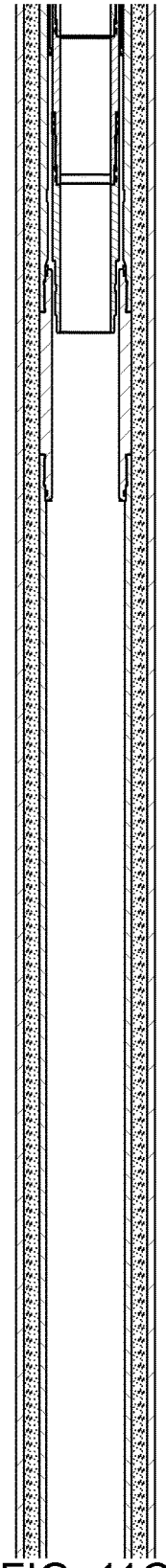
Figure 11D:
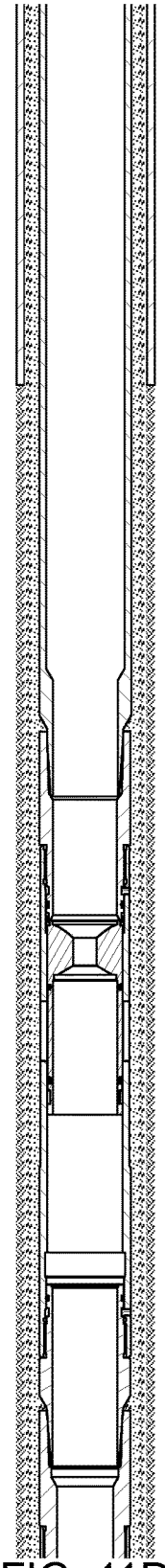
Figure 11E:
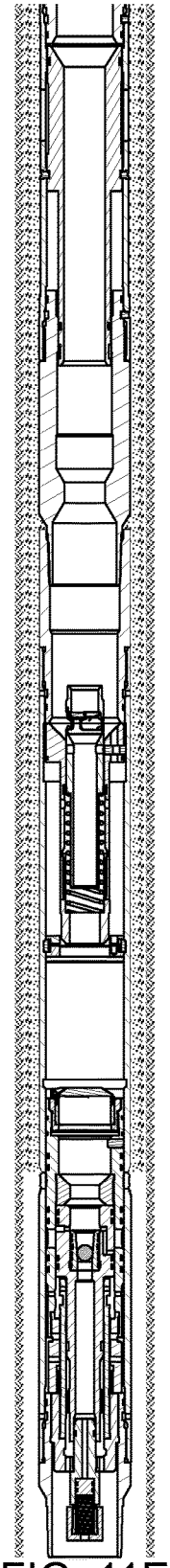

The driver 54*d* may have solid upper and lower connector portions and split segments extending between the connector portions. Each driver segment may have a cleat 54*c* formed in an outer surface thereof. The driver segments may allow radial movement of the cleats 54*c* between an extended position (shown) and a retracted position (FIG. 11B) and may have a stiffness urging the cleats toward the extended position. Each driver cleat 54*c* may have chamfered upper and lower faces and a groove formed in an outer surface thereof. The chamfered faces of the cleats 54*c* may interact with chamfers of the liner string upper portion to radially push the cleat to the retracted position in response to longitudinal movement of the setting tool 54 relative to the liner string 30 and the cleats 54*c* may engage a latch profile 36*p* of a sleeve 36 of the liner crossover valve 34, thereby fastening the driver 54*d* to the sleeve for shifting thereof. The driver 54*d* may retract in response to a longitudinal release force exerted on the LDA 2*d*.

The driver connector portions may each have a threaded coupling formed in an inner surface thereof. The slider 54*s* may be a nut engaged with the threaded coupling of the upper connector portion, thereby connecting the slider and the driver 54*d*. The slider 54*s* may be linked to the mandrel 78 by entrapment between a shoulder formed in an outer surface of the upper valve mandrel section 78*a* and a lower face of the lower catcher mandrel section 75*c*. A gap may be formed between the catcher mandrel 75 and the valve mandrel 78 to accommodate operation of the traveling valve 55.

The housing 79 may be tubular and have threaded couplings formed at each longitudinal end thereof. The housing 79 may include two or more sections 79*u,b* interconnected, such as by threaded couplings. Engagement of the upper threaded coupling of the housing 79 and the lower threaded coupling of the driver 64*d* may connect the two members. The upper housing section 79*u* may carry one or more seals along an inner surface thereof and engaged with an outer surface of the upper mandrel section 78*u* for isolating the LDA bore from the annulus 10*a*. The upper housing section 79*u* may have a shoulder formed in an outer surface thereof adjacent to the lower threaded coupling thereof and the shoulder may trap one or more of the packoffs 72 between a corresponding upper face of the adjacent lower housing section 79*b*. The packoff outer seals may engage an inner surface of the lower seal tube 34*f* when the respective packoff 72 is aligned therewith. The lower housing section 79*b* may carry a seal adjacent to the upper threaded coupling thereof for isolating the threaded connection with the upper housing section 79*u* from the annulus 10*a*.

The lower housing section 79*b* may have an upper shoulder formed in an inner surface thereof adjacent to the upper threaded coupling thereof and the shoulder may trap the upper sliding seal 81*u* between a corresponding upper face of the adjacent lower housing section 79*b*. The lower housing section 79*b* may also have a lower shoulder formed in an inner surface thereof adjacent to the lower threaded coupling thereof and the shoulder may trap the lower sliding seal 81*b* between a corresponding upper face of the adjacent detent 82. A valve chamber may be formed radially between the mandrel 78 and the housing 79 and longitudinally between the shoulders of the lower housing section 79*b*. Each sliding seal 81*u,b* may include a gland, one or more (two shown) inner seals, and an outer seal. The gland may have a recess formed in an inner surface thereof for receiving each inner seal. Each inner seal may be engaged with an outer surface of the mandrel 78 and the sliding seals 81*u,b* may straddle the valve chamber for isolation thereof. The outer seal may be carried in a groove formed in an outer surface of the gland to isolate an interface formed between the gland and the lower housing section 79*b*.

Figures 8A, 8B, 8C, 8D, 8E:
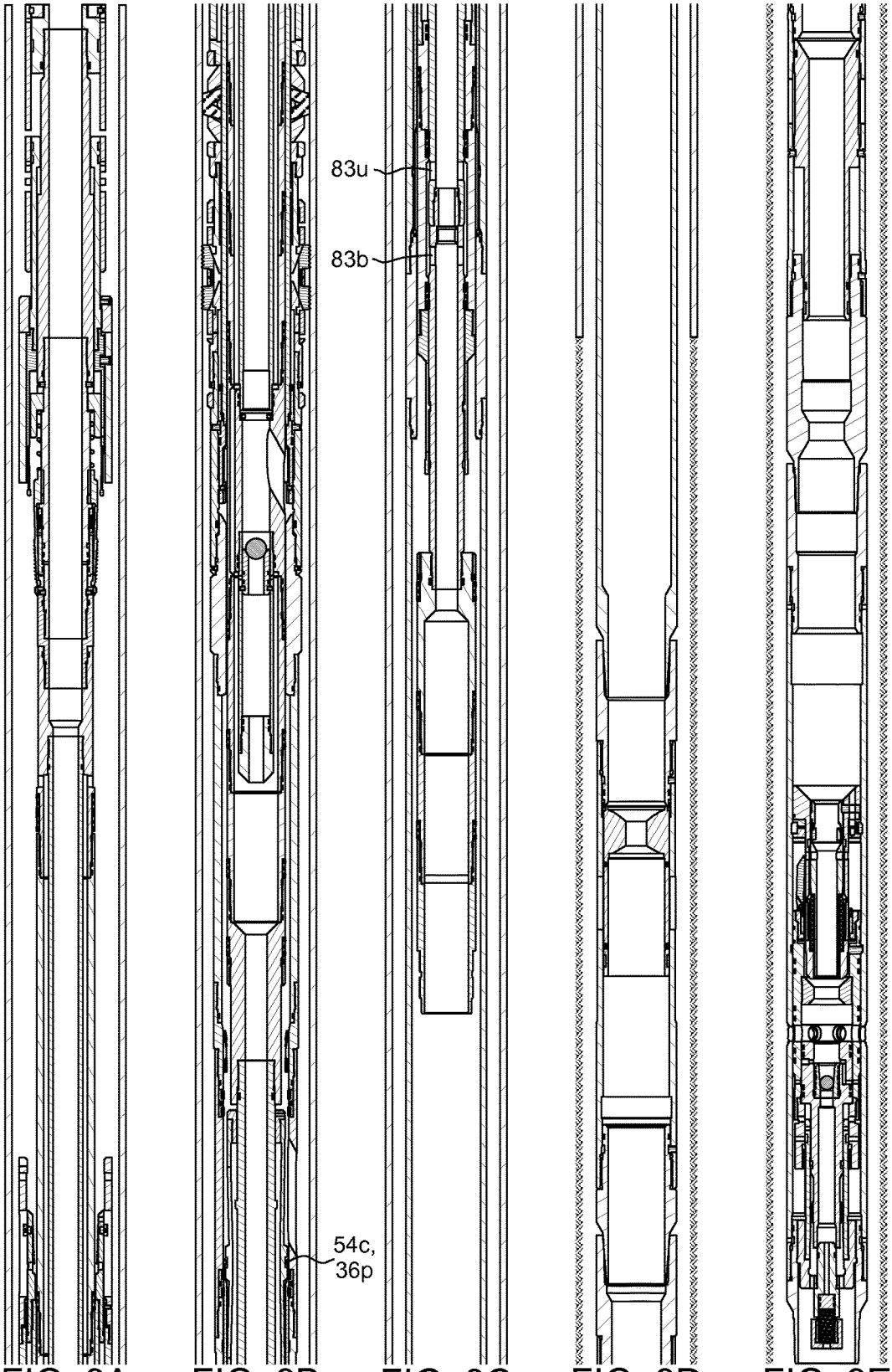
FIGS. 8A-8E illustrate opening of the crossover sleeve.

The check valve 80 may include a portion of the mandrel 78 forming a seat 80*s* and a valve member, such as a flapper 80*f*, pivotally connected to the mandrel and biased toward a closed position, such as by a torsion spring 80*g*. The flapper 80*f* may be oriented to allow downward fluid flow therethrough and prevent reverse upward flow. One or more upper valve ports 83*u* may be formed through a wall of the upper mandrel section 78*a* and one or more lower valve ports 83*b* may be formed through a wall of the second mandrel section 78*b*. The valve ports 83*u,b* may straddle the check valve 80. The traveling valve 55 may have a check position (shown) and an open position (FIG. 8C). The valve ports 83*u,b* may be misaligned with the valve chamber in the check position such that the upper sliding seal 81*u* is disposed between the upper 83*u* and lower 83*b* valve ports. The valve ports 83*u,b* may be aligned in the open position such that the valve chamber provides fluid communication between the ports, thereby bypassing the check valve 80.

The detent 82 may have a solid upper connector portion, a solid lower portion, and split segments extending between the solid portions. The detent connector portion may have a threaded coupling formed in an outer surface thereof engaged with the lower threaded coupling of the housing 79, thereby connecting the detent 82 and the housing. Each detent segment may have a chamfered lug formed in an inner surface thereof for engagement with upper (FIG. 8C) and lower (shown) chamfered grooves formed in an outer surface of the second mandrel section 78*b*, thereby fastening the detent thereto for retaining the traveling valve in the respective open and check positions.

The detent segments may allow radial movement of the lugs between an engaged position (shown) and a disengaged position (not shown) and may have a stiffness urging the lugs toward the engaged position. The chamfers may interact to radially push the lugs to the disengaged position in response to longitudinal movement of the mandrel 78 relative to the housing 79. The detent 82 may retract in response to a longitudinal shifting force exerted on the LDA 2*d*. The shifting force may be selected to be less than the release force of the driver 54*d* such that engagement of the driver with the sleeve 36 may be used to shift the traveling valve 55 between the positions.

The liner packer 31 may include a setting sleeve 31*a,b*, a pair of cones 31*c,d*, and a packing element 31*e*. The setting sleeve 31*a,b* may include two or more sections interconnected, such as by threaded couplings. The upper setting sleeve 31*a* may have the other part of the torsional coupling formed in an upper end thereof and engaged with the mating torsional coupling of the outer running sleeve 65*o*. The liner packer 31 may also be linked to the liner mandrel 33 by one or more pin 33*p* and slot 31*f* connections to allow relative longitudinal movement therebetween while retaining a torsional connection. The packer 31 may also be linked to the liner mandrel 33 by a ratchet connection 31*g*, 33*r*. The ratchet connection 31*g*, 33*r* may include a ratchet ring 31*g* and a profile 33*r* of complementing teeth to allow downward movement of the packer 31 relative to the liner mandrel 33 while preventing upward movement of the packer relative to the liner mandrel. The lower setting sleeve 31*b* may have a stop shoulder formed in an inner surface thereof engaged with a corresponding stop shoulder formed in an outer surface of the mandrel 33.

Figures 6A, 6B, 6C, 6D, 6E:
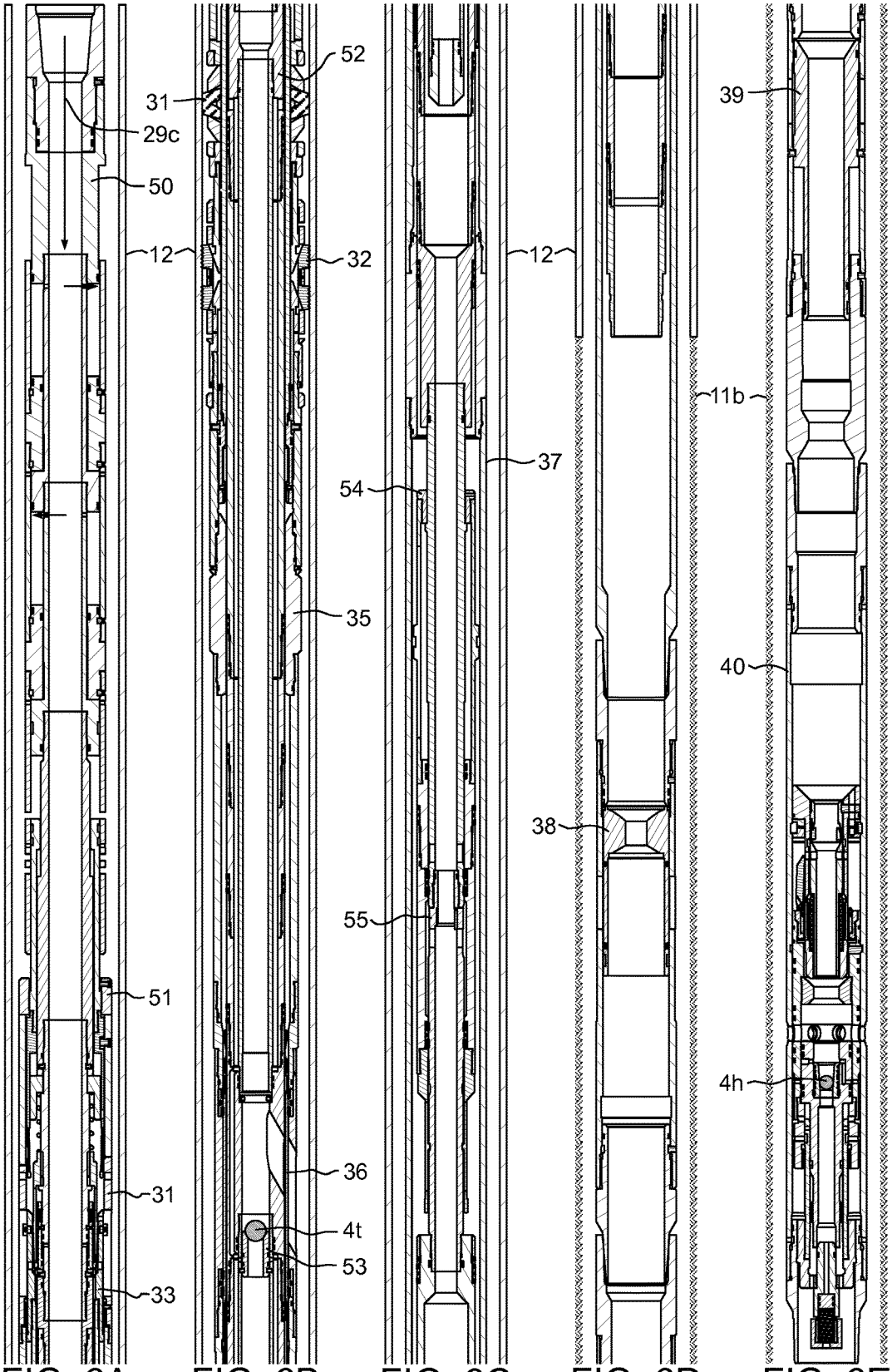
FIGS. 6A-6E illustrate setting of a hanger and packer of the liner string.
Figures 7A, 7B, 7C, 7D, 7E:
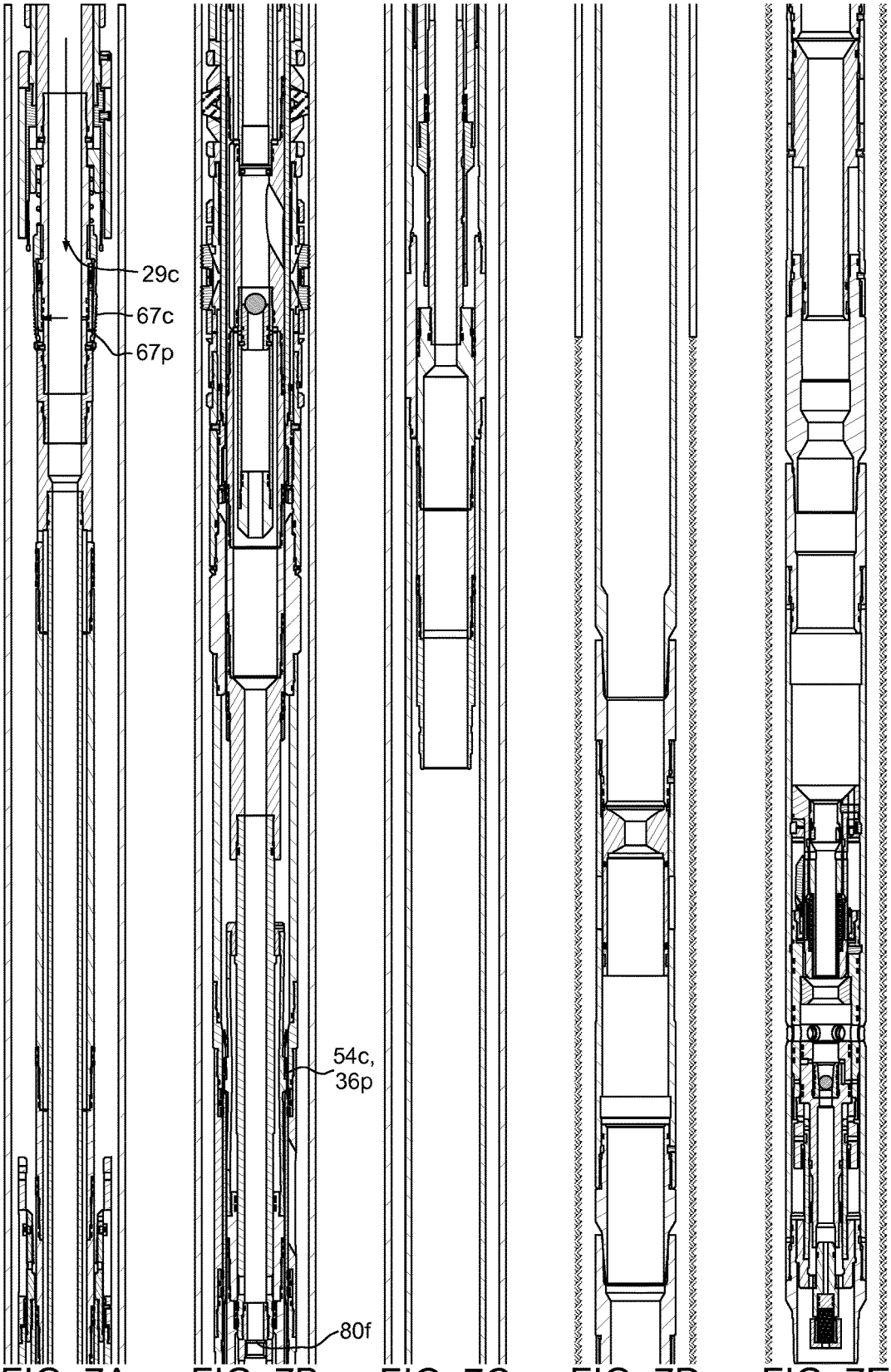
FIGS. 7A-7E illustrate engagement of a shifting tool of the deployment assembly with a crossover sleeve of the liner string.

The packing element 31*e* and cones 31*c,d* may be disposed along a recessed outer portion of the mandrel 33 and entrapped between a lower face of the lower setting sleeve 31*b* and an upper face of the liner hanger 32. The packing element 31*e* may be attached to a gland ring 31*h* at an inner surface thereof. The packing element 31*e* may be made from an expandable material, such as an elastomer or elastomeric copolymer. The packing element 31*e* may be naturally biased toward a contracted position (shown). The cones 31*c,d* may straddle the packing element 31*e* and compression of the packing element therebetween may radially expand the packing element into engagement with a lower portion of the casing string 12 (FIG. 6B), thereby isolating a lower portion of the annulus 10*a* from an upper portion of the annulus. The lower setting sleeve 31*b* may also carry a gage ring 31*j* for protecting the packing element 31*e*.

The liner hanger 32 may be disposed along the recessed outer portion of the mandrel 33 and include a nut 32*a*, a pair of cones 32*b,c*, a plurality of slips 32*d,e*, and a slip body 32*f*. The nut 32*a* may carry another gage ring 32*g* for protecting the packing element 31*e* and may be connected to the upper cone 32*b* by threaded couplings. The liner hanger 32 may be linked to the mandrel 33 by a slip joint. The slip joint may include a shoulder formed in an inner surface of the upper cone 32*b* engaged with a corresponding shoulder formed in an outer surface of the mandrel 33, thereby preventing upward movement of the upper cone relative to the mandrel which could otherwise prematurely set the packing element 31*e*. The slip joint may further include a groove formed along an inner surface of the upper cone 32*b*, thereby allowing downward movement of the upper cone relative to the mandrel 33 for accommodating setting of the hanger 32 and packer 31. The nut 32*a* may serve as a stop shoulder for the slip joint. The lower cone 32*c* may be connected to the mandrel 33 by threaded couplings secured by a fastener, such as a set screw.

Each slip 32*d,e* may be radially movable between an extended position (FIG. 6B) and a retracted position (shown) by relative compressive movement between the cones 32*b,c* and the slips. Each slip 32*d,e* may have teeth formed along an outer surface thereof and be made from a hard material, such as tool steel, ceramic, or cermet, for engaging and penetrating an inner surface of the casing 12, thereby anchoring the liner string 30 to the casing. Each slip 32*d,e* may be disposed in a respective pocket formed in the slip body 32*f* and may be biased toward the retracted position by a respective compression spring 32*h,j*. Each compression spring 32*h,j* may have an outer end connected to the body 32*f* and an inner end received in a groove formed in an outer surface of the respective slip 32*d,e*.

The slip body 32*f* may be linked to the cones by a slip joint. The slip joint may include a shoulder formed in an inner surface of the slip body 32*f* engaged with a corresponding shoulder formed in an outer surface of the upper cone 32*b*, thereby preventing downward movement of the slip body relative to the cone. The slip joint may further include one or more upper shearable fasteners 32*k* and one or more lower shearable fasteners 32*m* releasably connecting the slip body 32*f* to the cones 32*b,c*. The shearable fasteners 32*k,m* may be shear screws, each received in a respective threaded socket formed through a wall of the slip body 32*f* and extending into a respective indention formed in an outer surface of the respective cone 32*b,c*, thereby longitudinally and torsionally connecting the members. The slip joint may be released by a release differential between a higher pressure in the LDA bore and lower pressure in the annulus 10*a*.

Once the release pressure has been achieved, the fasteners 32*k,m* may fracture, thereby releasing the slip body 32*f* from the respective cones 32*b,c*. The release pressure of the upper and lower fasteners may be equal and a cumulative release pressure thereof may be selected to be greater than the activation pressure of the actuator 58 and less than the release pressure of the shearable fasteners 68. Each cone 32*b,c* may have a sleeve portion along which the slip body 32*f* may move after release of the slip joint. A length of each sleeve portion may be selected for accommodating setting of the hanger 32. The nut 32*a* and a shoulder formed in an outer surface of the lower cone 32*c* may each serve as a stop shoulder for the slip joint.

The liner mandrel 33 may be tubular and have a threaded coupling formed at a lower end thereof. The liner mandrel 33 may include two or more sections 33*a-d*. The upper 33*a*, second 33*b*, and third 33*c* mandrel sections may be interconnected, such as by threaded couplings. The third 33*c* and lower mandrel sections 33*d* may be longitudinally and torsionally connected by an emergency disconnect joint which may be released by articulation of the workstring 2 in response to malfunction of the LDA 2*d* and/or liner string upper portion.

The upper mandrel section 33*a* may have the teeth formed in an inner surface thereof engaged with the lower collet 67*c* and carry the pins 33*p* in respective threaded sockets formed in an outer surface thereof. The upper mandrel section 33*a* may also have the latch groove formed in the inner surface thereof engaged with the upper collet 66*c* and the shoulder formed in the inner surface thereof engaged with the slotted shoulder 73*s*. The upper mandrel section 33*a* may also have the ratchet profile 33*r* formed in the outer surface thereof and the bypass ports 33*y* formed through a wall thereof.

The second mandrel section 33*b* may have an outer diameter less than the outer diameter of the upper mandrel section, thereby forming the recessed outer portion. The second mandrel section 33*b* may also have the shoulder formed in an outer surface thereof engaged with the inner shoulder of the upper hanger cone 32*b*. The lower mandrel section 33*d* may have the threaded coupling formed at an upper end thereof connected to the lower hanger cone 32*c* and may carry a gage ring 33*g*.

The liner crossover valve 34 may include a body 35, a pair of sliding seals 34*u,b*, and the sleeve 36. The valve body 35 may be tubular and have threaded couplings formed at each longitudinal end thereof. The valve body 35 may include two or more sections, such as the upper seal tube 35*a*, an upper extension 35*b*, a release section 35*c*, a port section 35*d*, a lower extension 35*e*, and the lower seal tube 35*f*, interconnected, such as by threaded couplings. Engagement of the upper threaded coupling of the body 35 and the lower threaded coupling of the mandrel 33 may connect the two members. The lower mandrel section 33*d* may carry one or more seals along an inner surface thereof and engaged with an outer surface of the upper seal tube 34*b* for isolating the LDA/liner interface from the annulus 10*a*. The threaded connection between the liner mandrel 33 and the body 35 may also be secured by one or more fasteners, such as set screws. The threaded connections between the intermediate body sections 35*a-f* may have a seal carried by either adjacent member for isolating the LDA/liner interface from the annulus 10*a*.

The port section 35*d* may have a crossover port 35*x* formed through a wall thereof and the sliding seals 34*u,b* may straddle the crossover port. The sliding seals 34*u,b* may be similar to the sliding seals 81*u,b* discussed above. The port section 35*d* may also have a pair of shoulders, each formed in an inner surface thereof adjacent to the respective threaded coupling thereof and each shoulder may trap the respective sliding seal 34*u,d* between a corresponding adjacent end face of the respective adjacent body section 35*c,e*. The sleeve 36 may be disposed in the body 35 and longitudinally movable relative thereto between a closed position (shown) and an open position (FIG. 8B). An outer surface of the sleeve 36 may cover the crossover port 35*x* and be engaged with the sliding seals 34*u,b* in the closed position. When opening, the sleeve 36 may move downward relative to the body 35 and into engagement with an upper face of the lower seal tube 35*f*, thereby exposing the crossover port 35*x* and providing fluid communication between the LDA bore and the annulus 10*a* via the LDA crossover port 74*x*.

The sleeve 36 may have the latch profile 36*p* formed in an inner surface thereof adjacent at an upper end thereof. The latch profile 36*p* may be a groove having a radially flat upper opener shoulder and a chamfered lower closer shoulder. A length of the latch groove may correspond to a length of the cleats 54*c* between the cleat grooves and the lower chamfered faces thereof for receiving a lower portion of the cleats, thereby fastening the driver 54*d* to the sleeve 36. The release section 35*c* may have a ribbed inner surface for receiving an upper face of the sleeve 36 in the open position and for engagement with the cleat chamfered upper faces to retract the cleats 54*c* for releasing the sleeve. The lower seal tube 35*f* may have a shoulder formed in an upper face thereof for receiving a lower face of the sleeve 36.

The sleeve 36 may also have a detent 36*d* formed in a recessed lower portion thereof. The detent 36*d* may have split segments and chamfered lugs formed in an outer surface thereof for engagement with upper (shown) and lower (FIG. 8C) chamfered grooves formed in an inner surface of the lower extension 35*e*, thereby fastening the detent thereto for retaining the sleeve 36 in the respective closed and open positions. The detent segments may allow radial movement of the lugs between an engaged position (shown) and a disengaged position (not shown) and may have a stiffness urging the lugs toward the engaged position. The chamfers may interact to radially push the lugs to the disengaged position in response to longitudinal movement of the sleeve 36 relative to the body 35. The detent 36*d* may retract in response to a longitudinal shifting force exerted on the sleeve 36. The shifting force may be selected to be less than the release force of the driver 54*d* such that engagement of the driver with the sleeve 36 may be used to shift the crossover valve 34 between the positions. The sleeve 36 may have an upper chamfered shoulder formed in an inner surface thereof adjacent to an upper end of the detent 36*d* and a lower chamfered shoulder formed in the inner surface thereof adjacent to a lower end of the detent for retracting the cleats 54*c*.

The adapter 37 may be tubular and have threaded couplings formed at each longitudinal end thereof. Engagement of the upper threaded coupling of the adapter 37 and the lower threaded coupling of the lower seal tube 35*f* may connect the two members.

Figure 3A:
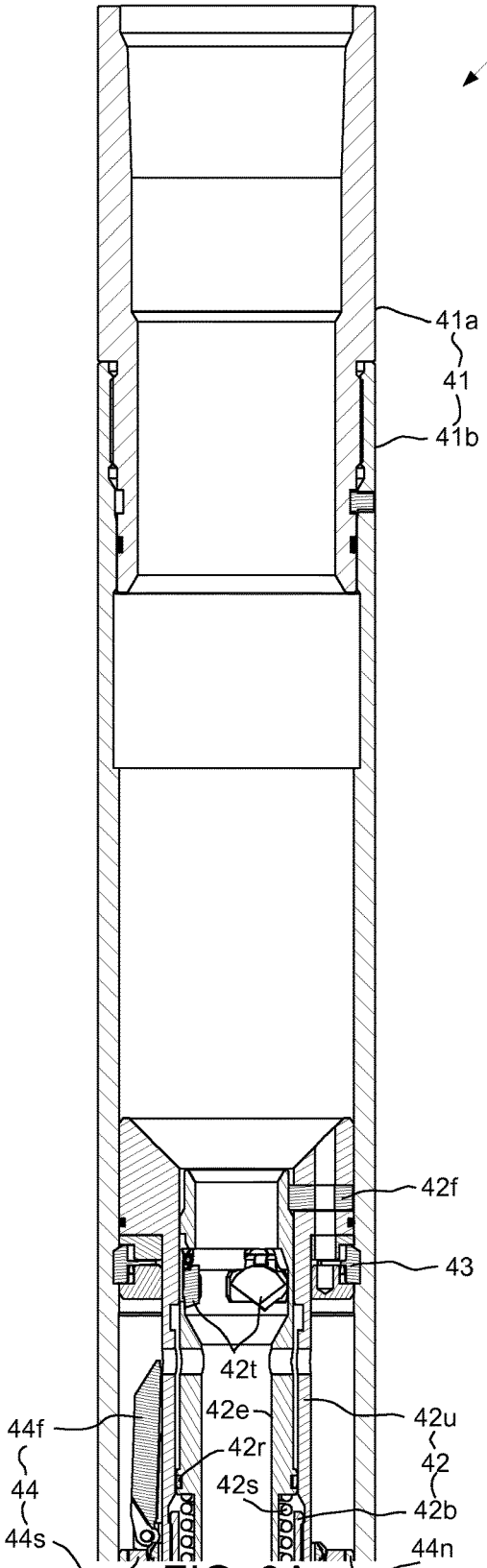
FIGS. 3A and 3B illustrate a reverse cementing valve (RCV) of the liner string.
Figure 3B:
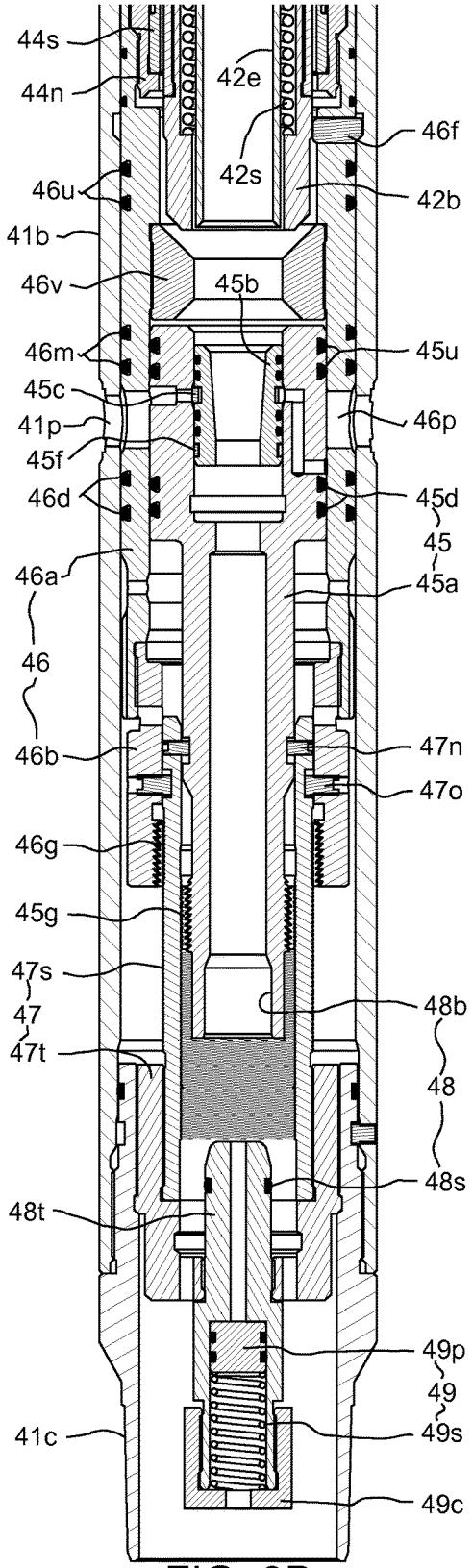
Figures 4A, 4B, 4C, 4D, 4E:
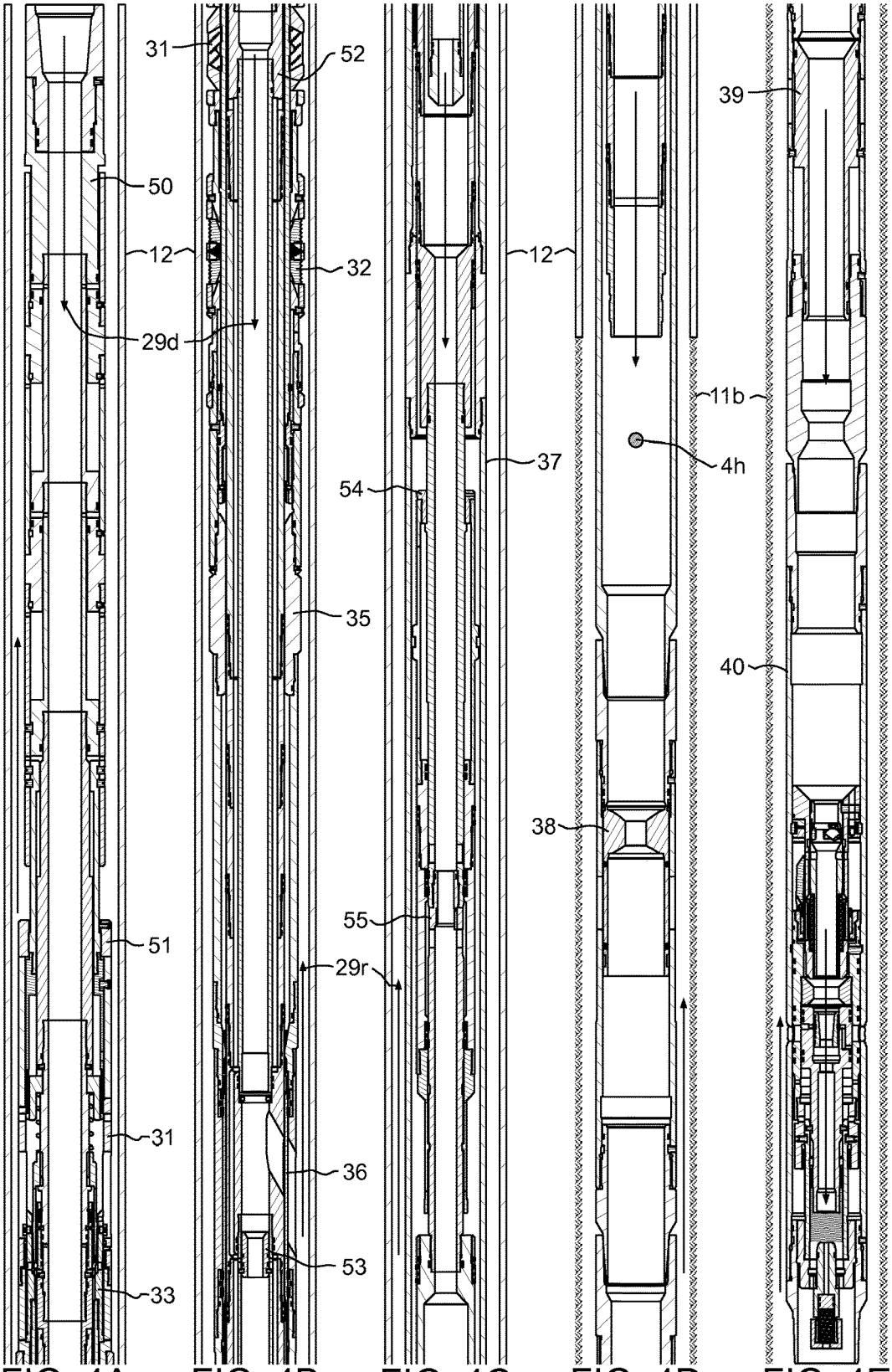
FIGS. 4A-4E illustrate pumping of a shifting plug to the RCV.

FIGS. 3A and 3B illustrate the RCV 40. The RCV 40 may include a housing 41, a prop valve 42, a stopper 43, a check valve 44, an inner port valve 45, an outer port valve 46, a linkage 47, a bore valve 48 and a relief valve 49. Except for the housing 41, the RCV components may be made from a drillable material for later drill-out. The housing 41 may be tubular and have threaded couplings formed at each longitudinal end thereof. The housing 41 may include two or more sections 41*a-c* interconnected, such as by threaded couplings. The upper 41*a* and lower 41*c* housing sections may each carry a seal along an outer surface thereof and engaged with a respective inner surface of the mid housing section 41*b* for isolating a bore of the RCV 40 from the annulus 10*a*. The threaded connections between the upper 41*a* and mid 41*b* housing sections and between the mid and lower 41*c* housing sections may each be secured by fastener, such as a set screw. The mid housing section 41*b* may have one or more ports 41*p* formed through a wall thereof.

The outer port valve 46 may include a sleeve 46*a,b*, sliding seals 46*u,m,d*, a fastener 46*f*, a ratchet ring 46*g*, and a venturi ring 46*v*. The sleeve 46*a,b* may have an upper port section 46*a* and a lower locking section 46*b* interconnected, such as by threaded couplings. The port section 46*a* may have one or more ports 46*p* formed through a wall thereof and corresponding to the housing ports 41*p*. The port section 46*a* may carry the sliding seals 46*u,m,d* along an outer surface thereof and the mid 46*m* and lower 46*d* sliding seals may straddle the port 46*p*. The venturi ring 46*v* may be connected to the port section 46*a* by threaded couplings and serve to stabilize flow through the RCV bore.

The sleeve 46*a,b* may be disposed in the housing 41 and longitudinally movable relative thereto between an open position (shown) and a closed position (FIG. 10E). In the open position, the sleeve ports 46*p* may be aligned with the housing ports 41*p*. When closing, the sleeve 46*a,b* may move downward relative to the housing 41 until a lower face of the locking section 46*b* engages with an upper face of the lower housing section 41*c*. In the closed position, an outer surface of the port section 46*a* may cover the housing port 41*p* and an inner surface of the mid housing section 41*b* may be engaged with the upper 46*u* and mid 46*m* sliding seals.

The outer port valve 46 may be kept in the open position by the fastener 46*f* carried by the port section 46*a*. The fastener 46*f* may be a dog radially movable relative to the port section 46*a* between an extended position (shown) and a retracted position (FIG. 10E). In the extended position, the dog may extend into a latch groove formed in the inner surface of the mid housing section 41*b*, thereby fastening the sleeve 46*a,b* to the housing 41. The dog may be kept in the extended position by engagement with the prop valve 42. The locking section 46 also carry the ratchet ring 46*g* along an inner surface thereof and the outer port valve 46 may also be kept in the open position by the linkage 47.

The linkage 47 may include a nut 47*t*, a ratchet sleeve 47*s*, and one or more releasable connections. The nut 47*t* and ratchet sleeve 47*s* may be connected by threaded couplings. The nut 47*t* may also be connected to the lower housing section 41*c* by threaded couplings. The nut 47*t* may have one or more flow passages 47*p* formed therethrough. Each releasable connection may include one or more shearable fasteners 47*n,o*. The outer shearable fasteners 47*o* may be shear screws, each received in a respective threaded socket formed through a wall of the locking section 46*b* and extending into a groove formed in an outer surface of the ratchet sleeve 47*s*, thereby longitudinally connecting the outer port valve 46 to the housing 41. The outer port valve 46 may be closed by a closing differential between a higher pressure in the RCA bore and lower pressure in the annulus 10*a*. Once the closing pressure has been achieved, the fasteners 47*o* may fracture, thereby releasing the outer port valve 46 from the housing 41.

The ratchet sleeve 47*s* may have inner and outer ratchet profiles formed along respective inner and outer surfaces thereof. Engagement of the ratchet ring 46*g* with complementing teeth of the outer ratchet profile may allow downward movement of the outer port valve 46 relative to the housing 41 while preventing upward movement of the outer port valve relative to the housing, thereby keeping the outer port valve in the closed position.

Figures 5A, 5B, 5C, 5D, 5E:
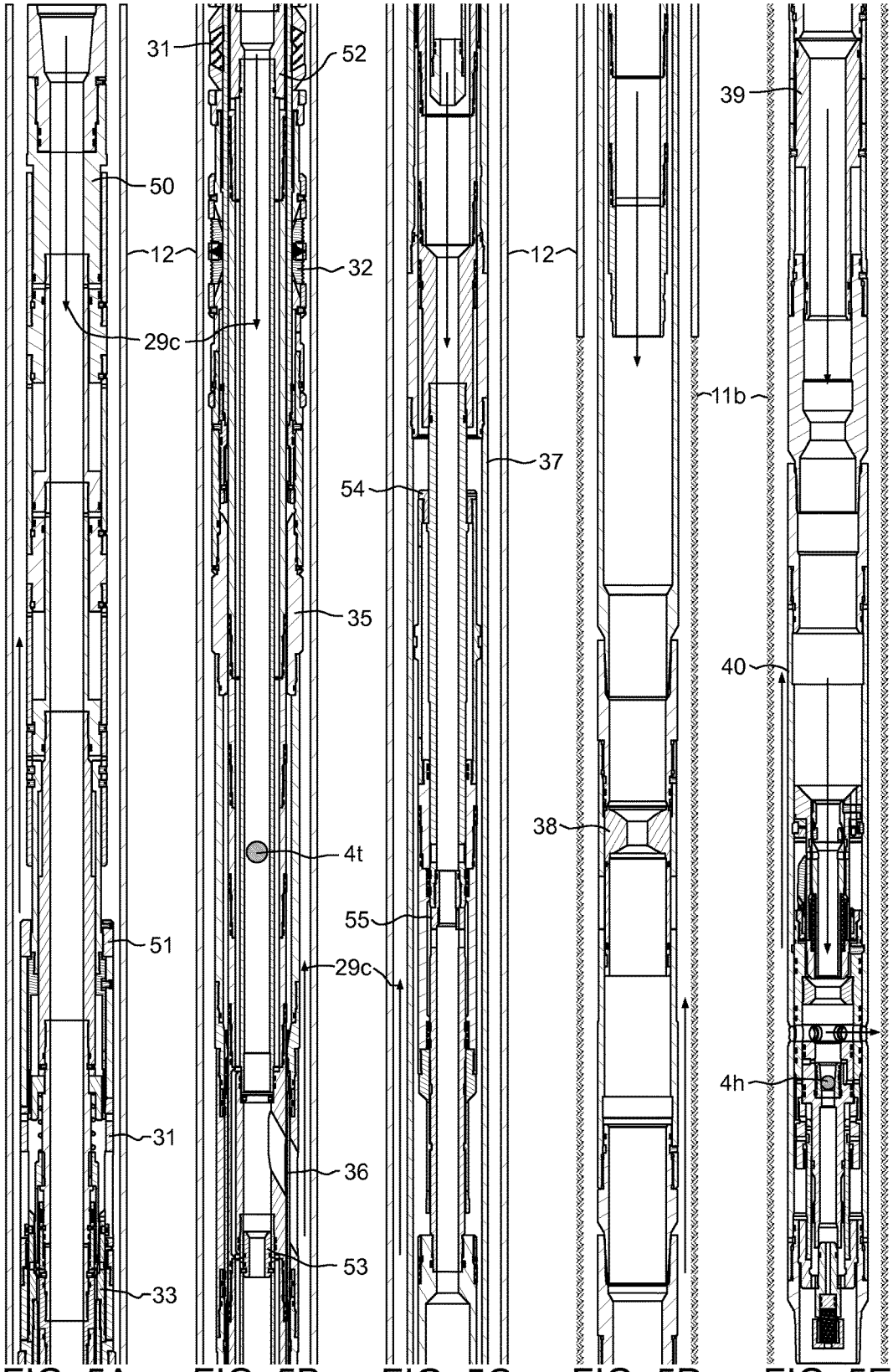
FIGS. 5A-5E illustrate pumping of a setting plug to the deployment assembly.

The inner port valve 45 may include a sleeve 45*a*, a seat 45*b*, sliding seals 45*u,d*, one or more detents 45*c,f*, and a ratchet ring 45*g*. The sleeve 45*a* may carry the sliding seals 45*u,d* along an outer surface thereof and have a shoulder formed in an outer surface thereof. The sleeve 45*a* may be disposed in the housing 41 and longitudinally movable relative thereto between a closed position (shown) and an open position (FIG. 5E). An outer surface of the sleeve 45*a* may cover the outer port valve ports 46*p* and the sliding seals 45*u,d* may be engaged with an inner surface of the port section 46*a* and straddle the ports 46*p* in the closed position. When opening, the sleeve 45*a* may move downward relative to the outer port valve 46 until the shoulder thereof engages with a shoulder formed in the inner surface of the locking section 46*b*, thereby exposing the outer port valve ports 46*p* and providing fluid communication between the RCV bore and the annulus 10*a* via the housing ports 41*p*.

The inner shearable fasteners 47*n* may be shear screws, each received in a respective threaded socket formed through a wall of the ratchet sleeve 47*s* and extending into a groove formed in an outer surface of the inner port valve sleeve 45*a*, thereby longitudinally connecting the inner port valve 45 to the housing 41. The inner port valve 45 may be opened by an opening differential between a higher pressure in the RCA bore and lower pressure in the annulus 10*a*. Once the opening pressure has been achieved, the fasteners 47*n* may fracture, thereby releasing the inner port valve 45 from the housing 41. The opening differential of the inner port valve 45 may be less than the closing differential of the outer port valve 46. The opening differential of the inner port valve 45 may be greater than the release differential of the seat 45*b*.

The sleeve 45 may also carry the ratchet ring 45*g* along an outer surface thereof and the inner port valve 45 may be kept in the closed position by the linkage 47. Engagement of the ratchet ring 45*g* with complementing teeth of the inner ratchet profile may allow downward movement of the inner port valve 45 relative to the housing 41 while preventing upward movement of the outer port valve relative to the housing, thereby keeping the inner port valve in the open position.

The seat 45*b* may be disposed in the sleeve 45*a* and longitudinally movable relative thereto between an upper position (shown) and a lower position (FIG. 5E). The seat 45*b* may carry the upper detent 45*c* in an outer surface thereof for keeping the seat in the upper position and the lower detent 45*f* in the outer surface thereof for keeping the seat in the lower position. Each detent 45*c,f* may engage a respective latch groove formed in an inner surface of the sleeve 45*a*. The seat 45*b* may be moved from the upper position to the lower position in response to landing of the shifting plug 4*h* into the seat and exertion thereon of an release differential between a higher pressure in the RCV bore and a lower pressure in the annulus 10*a*, thereby releasing the seat from the sleeve 45*a*. Once released, the seat 45*b* may travel downward relative to the sleeve 45*a* until a lower face of the seat engages a shoulder formed in an inner surface of the sleeve. Pressure in an upper portion of the RCV bore may be increased to the closing pressure of the inner port valve 45 such that the shifting ball 4*h* and seat 45*b* may release the sleeve 45*a* and drive the sleeve downward to open the inner port valve.

The sleeve 45*a* may also have a pair of vents formed through a wall thereof and extending from the upper latch groove. The seat 45*b* may carry sliding seals straddling the upper detent 45*c* to close the vents in the upper position and downward movement of the seat may open the vents.

The bore valve 48 may include a stem 48*t*, a sliding seal 48*s*, and a seal bore 48*b*. The stem 48*t* may be connected to the nut 47*t* by threaded couplings. The seal bore 48*b* may be formed in the inner surface of the sleeve 45*a*. The stem 48*t* may carry the sliding seal 48*s* on an outer surface thereof. The seal bore 48*b* may be longitudinally movable relative to the stem between an open position (shown) and a closed position (FIG. 10E). The seal bore 48*b* may be clear of the sliding seal 48*s* in the open position and be engaged with the sliding seal in the closed position. The bore valve 48 may be closed by engagement of a lower face of the venturi ring 46*v* with an upper face of the sleeve 45*a* as the outer port valve 46 is closing.

The relief valve 49 may include a piston 49*p*, a compression spring 49*s*, and a cap 49*c*. The stem 48*t* may have a recess formed in an inner surface thereof along a lower portion thereof. The piston 49*p* and the compression spring 49*s* may be disposed in the recess and the piston may be longitudinally movable relative to the stem 48*t* between a closed position (shown) and an open position (not shown). The piston 49*p* may carry one or more seals in an outer surface thereof for sealing against the recess. The stem 48*t* may have a bore formed through an upper portion thereof in fluid communication with the recess for serving as an inlet and the cap 49*c* may have an outlet port formed therethrough. The cap 49*c* may be connected to the stem 48*t* by threaded couplings and the compression spring 49*s* may be shouldered against the piston 49*p* and the cap 49*c*, thereby biasing the piston toward the closed position. A set pressure of the relief valve 49 may correspond to a design pressure of the RCV 40 and the relief valve 49 may open to prevent hydraulic lock in the RCV.

The check valve 44 may include a seat 44*s*, a nut 44*n*, and a valve member, such as a flapper 44*f*, pivotally connected to the seat 44*s* and biased toward a closed position (FIG. 10E), such as by a torsion spring (not shown). The flapper 44*f* may be oriented to allow upward fluid flow therethrough and prevent reverse downward flow. The nut 44*n* may be connected to the port section 46*a* by threaded couplings. The seat 44*s* may be received in the nut 44*n* and connected thereto, such as by an interference fit or fastener. The flapper 44*f* may be propped open (shown) by the prop valve 42 extending therethrough. In the closed position, the flapper 44*f* may serve as an actuator piston to release the outer port valve 46 from the housing 41 and move the outer port valve to the closed position.

The prop valve 42 may include an upper sleeve 42*u*, a lower sleeve 42*b*, a fastener 42*f*, a compression spring 42*s*, and a check valve 42*e,r,t*. The upper and lower prop sleeves 42*u,b* may be connected together by threaded couplings. The fastener 42*f* may be a dog carried by the upper sleeve 42*u* and radially movable relative thereto between an extended position (FIG. 9E) and a retracted position (shown). In the retracted position, the dog may extend into a latch groove formed in an outer surface of the check valve 42*e,r,t*, thereby fastening the check valve to the sleeves 42*u,b*. The dog may be kept in the retracted position by engagement with an inner surface of the mid housing section 41*b*. The dog may be extended by alignment with a latch groove formed in an inner surface of the mid housing section 41*b*, thereby releasing the check valve 42*e,r,t* from the prop sleeves 42*u,b*.

The check valve 42*e,r,t* may include a seat 42*e*, a fastener 42*r*, and a valve member, such as a segmented flapper. The segmented flapper may be a tri-flapper 42*t* including three flapper segments (only two shown), each pivotally connected to the seat 42*e* and biased toward a closed position (FIG. 10E), such as by a torsion spring. The tri-flapper 42*t* may be oriented to allow downward fluid flow therethrough and prevent reverse upward flow. The seat 42*e* may have one or more bypass ports formed through a wall thereof below the tri-flapper pivots. The check valve 42*e,r,t* may be disposed in the sleeves 42*u,b* and longitudinally movable relative thereto between a captured position (shown) and a released position (FIG. 9E). The check valve 42*e,r,t* may be kept in the captured position by the engaged dog.

The compression spring 42*s* may be disposed in a spring chamber formed between the seat and the lower sleeve 42*b* and against an upper shoulder formed in an outer surface of the seat and a lower shoulder formed in an inner surface of the lower sleeve 42*b*, thereby biasing the check valve 42*e,r,t* toward the released position. In the captured position, the bypass ports may be covered by the upper sleeve 42*u* and in the released position, the bypass ports may be exposed, thereby allowing upward fluid flow to bypass the tri-flapper 42*t*. The fastener 42*r* may be a snap ring carried by the seat 42*e*. The snap ring may be naturally biased toward an extended position (FIG. 9E) for engagement with a latch groove formed in an inner surface of the upper sleeve 42*u* to keep the check valve 42*e,r,t* in the released position.

In the closed position, the tri-flapper 42*t* may serve as an actuator piston to longitudinally move the prop sleeves 42*u,b* from the propped position (shown) upward to a released position (FIG. 9E). The prop sleeves 42*u,b* may be stopped in the released position by engagement of an upper face of the upper sleeve 42*u* with a lower face of the upper housing section 41*u*. The prop sleeves 42*u,b* may be clear of the flapper 44*f* in the released position and may be kept in the released position by engagement of an outer surface of the seat 42*e* with the extended dog.

The stopper 43 may include upper and lower retainers and one or more fasteners, such as dogs, disposed in a groove formed in an outer surface of the retainers. The dogs may each be biased (not shown) toward an extended position (shown) in engagement with a latch groove formed in an inner surface of the mid housing section 41*b*.

FIGS. 4A-4E illustrate pumping of a shifting plug 4*h* to the RCV 40. Once the liner string 30 has been advanced 8*a* into the wellbore 10*w* by the workstring 2 to the desired deployment depth, the shifting plug launcher 28 may be operated and the drilling fluid 29*d* may propel the shifting plug 4*h* down the workstring 2 and to the RCV seat 45*b* via a lower portion of the liner adapter 37, the fracture valve 38, and the toe sleeve 39. Rotation 8*r* of the workstring 2 and liner string 30 may continue during pumping of the shifting plug 4*h*.

FIGS. 5A-5E illustrate pumping of the setting plug 4*t* to the deployment assembly 2*d*. Once the shifting plug 4*h* has landed in the RCV seat 45*b*, continued pumping of the drilling fluid 29*d* may increase pressure on the seated plug. The RCV seat 45*b* may be released once the release differential has been achieved. The seated shifting plug 4*h* and RCV seat 45*b* may travel downward until the seat engages the inner port valve sleeve 45*a*. The sleeve 45*a* may be released once the opening differential has been achieved. The sleeve 45*a*, seat 45*b*, and seated shifting plug 4*h* may travel downward until the sleeve 45*a* engages the locking sleeve 46*b*, thereby opening the inner port valve 45. Rotation 8*r* of the workstring 2 and liner string 30 may continue during shifting of the RCV 40.

Once the RCV 40 has been shifted, rotation 8*r* may be halted and the cementing head 6 may be installed between the workstring 2 and the top drive 5 and conditioner 29*c* may be circulated by the cement pump 16 through the valve 25*c* to prepare for pumping of cement slurry 29*s* (FIG. 9B). The setting plug launcher may then be operated and the conditioner 29*c* may propel the setting plug 4*t* down the workstring 9 to the catcher 53.

FIGS. 6A-6E illustrate setting of the hanger 32 and packer 31 of the liner string 30. Once the setting plug 4*t* has landed in the seat 76*s* of the catcher 53, continued pumping of the conditioner 43 may increase pressure on the seated plug, thereby also pressurizing the actuation chambers of the actuator 58 until the activation differential is achieved and the actuator pistons 59*u,b* are released. The actuator pistons 59*u,b* may in turn exert a setting force on the liner hanger 32 and packer 31 via the actuator sleeve 60*c*, slip joint, and running sleeves 65*n*, 65*o* until the release differential is achieved and the hanger is released. The actuator pistons 59*u,b*, actuator sleeves 60*a-c*, slip joint, packer 31, upper collet 61*c*, and an upper portion of the liner hanger 32 may travel downward until the hanger slips 32*d,e* and the packing element 31*e* are set against the casing string 12, thereby halting the movement. The upper collet 61*c* may disengage from the packer latch groove once the lugs clear the lock ring 66*k*.

Continued pumping of the conditioner 29*c* may further pressurize the actuation chambers until the release differential is achieved, thereby fracturing the slip joint fasteners 68 and releasing the running sleeves 65*n,o* from the actuator 58. The liner hanger 32 and packer 31 may be restrained from unsetting by the ratchet connection 31*g*, 33*r*. Downward movement of the actuator pistons 59*u,b* and actuator sleeves 60*a-c* may continue until the actuator pistons reach lower ends of the actuation chambers.

FIGS. 7A-7E illustrate engagement of the shifting tool 54 with the crossover sleeve 36. Continued pumping of the conditioner 29*c* may further pressurize the LDA bore (above the seated setting plug 4*t*). The release chamber of the running tool 51 may be pressurized and exert pressure on the lock piston 67*p* until the release differential is achieved and the lock piston is released. The lock piston 67*p* may travel upward, thereby releasing the lower latch collet 67*c* from the liner mandrel 33. Once the LDA 2*d* has been released from the liner string 30, circulation of the conditioner 29*c* may be halted. The traveling valve flapper 80*f* may close. The workstring 2 may then be raised until the cleats 54*c* engage the latch profile 36*p* of the crossover sleeve 36.

FIGS. 8A-8E illustrate opening of the crossover sleeve 36. Once the cleats 54*c* have engaged the crossover sleeve profile 36*p*, the workstring 2 may be lowered until the shifting force is achieved, thereby releasing the crossover sleeve detent 36*d* from the upper body groove. The cleat 54*c* and the latched crossover sleeve 36 may travel downward until the detent 36*d* engages the lower body groove and the crossover sleeve lower face engages the upper face of the lower seal tube 35*f*, thereby opening the crossover valve 34. Lowering of the workstring 2 may continue until a shifting force of the traveling valve 55 is achieved, thereby releasing the traveling valve detent 82 from a lower groove of the valve mandrel 78. The valve mandrel 78 may then travel downward until the traveling valve detent 82 engages the upper valve mandrel groove and/or a lower face of the catcher mandrel section 75*c* engages an upper face of the slider 54*s*, thereby opening the traveling valve 55.

FIGS. 9A-9E illustrate reverse cementing of the liner string 30. Lowering of the workstring 2 may continue until a release force is achieved, thereby releasing the cleats 54*c* from the crossover sleeve 36. The LDA 2*d* may then travel downward until the crossover port 74*x* is realigned with the open crossover port 35*x*. The cement slurry 29*s* may be pumped from the mixer 26 into the cementing head 6 via the valve 25*c* by the cement pump 16. Pressure may increase in the workstring bore and a lower portion of the annulus 10*a* against the closed tri-flapper 42*t*. The RCV prop valve 42 may travel upward until the fastener 42*f* is aligned with the upper latch groove of the housing 41, thereby allowing the compression spring 42*s* to push the fastener to the extended position and releasing the check valve 42*e,r,t*. The check valve 42*e,r,t* may travel upward to the released position, thereby opening the bypass ports of the seat 42*e*.

The cement slurry 29*s* may flow into the launcher and be diverted past the cementing plug 4*c* via a diverter and bypass passages of the cementing head 6. Once the desired quantity of cement slurry 29*s* has been pumped, the cementing plug 4*c* may be released from the launcher by operating the launcher actuator. The chaser fluid 29*h* may be pumped into the cementing swivel via the valve 25*c* by the cement pump 16. The chaser fluid 29*h* may flow into the launcher and be forced behind the cementing plug 4*c* by closing of the bypass passages, thereby propelling the plug into the workstring bore.

Pumping of the chaser fluid 29*h* by the cement pump 16 may continue until residual cement in the cement line 22 has been purged. Pumping of the chaser fluid 29*h* may then be transferred to the mud pump 17 by closing the valve 25*c* and opening the valve 25*m*. The cementing plug 4*c* and cement slurry 29*s* may be driven through the workstring bore to the LDA 2*d* by the chaser fluid 29*h*. The cement slurry 29*s* may be diverted from the LDA bore by the seated setting plug 4*t* and into the lower annulus portion via the crossover ports 74*x*, 35*x*. The cement slurry 29*s* may then flow down the lower annulus portion, thereby displacing conditioner 29*c* therefrom.

The displaced conditioner 29*c* may flow into the RCV 40 via the open ports 41*p*, 46*p* and past the prop valve 42 via the open bypass ports. The displaced conditioner 29*c* may flow upward through the liner bore into the LDA bore lower portion. The displaced conditioner 29*c* may bypass the closed traveling valve flapper 80*f* via the open valve ports 83*u,b* and continue up the LDA lower bore portion. The displaced conditioner 29*c* may be diverted from the LDA lower bore portion by the seated setting plug 4*t* and into the seat valve bypass passage 77. The displaced conditioner 29*c* may continue upward through the bypass passage 74*b* and the bypass passage 73*b*. The displaced conditioner 29*c* may exit the LDA via the bypass port 73*p* and flow up the bypass clearance 73*c* and to the liner mandrel bypass ports 33*y* via the slotted shoulder 73*s*. The displaced conditioner 29*c* may exit the liner 30 into an upper portion of the annulus 10*a* via the liner bypass ports 33*y* and flow up the annulus to the return line 24.

FIGS. 10A-10E illustrate closing of the crossover sleeve 36 and the RCV 40. Once the cementing plug 4*c* has reached a desired location within the LDA 2*d*, such as adjacent to the seated setting plug 4*c*, pumping of the chaser fluid 29*h* may be halted. The float collar check valve may close in response to halting of the pumping. The workstring 2 may then again be raised until the cleats 54*c* engage the latch profile 36*p* and the crossover sleeve 36 is returned to the closed position. The traveling valve 55 may be shifted back to the check position as the workstring 2 is being raised. Pumping of the chaser fluid 29*h* may then be resumed, thereby pressurizing the LDA bore upper portion. Once the opening differential of the seat valve 76 is achieved, the seat 76*s*, the seated setting plug 4*t*, and the cementing plug 4*c* may travel downward, thereby opening the seat valve 76 and transmitting pressure down the LDA bore and liner bore to the RCV 40. The flapper 44*f* may close and pressure exerted against the closed flapper may release the outer port valve 46 once the closing differential has been achieved. The outer port valve 46 may travel downward until the venturi ring 46*v* engages the inner port valve 45. Continued pumping of the chaser fluid 29*h* may drive the port valves 45, 46 downward until the locking section 46*b* engages the lower housing section 41*c*, thereby closing the outer port valve 46 and the bore valve 48.

FIGS. 11A-11E illustrate retrieval of the workstring 2 from the wellbore 10*w*. Once the RCV 40 has shifted, the workstring 2 may be raised to release the cleats 54*c* from the latch profile 36*p* and raising may continue until the LDA crossover port 74*x* is adjacent to a top of the liner string 30. Chaser fluid 29*h* may be pumped down the workstring 2 and discharged through the crossover port 74*x* into the annulus upper portion to purge any excess cement slurry from the LDA 2*d*. The workstring 2 may then be retrieved from the wellbore 10*w* to the rig 1*r* and the drilling system 1 may be dispatched from the wellsite.

Figure 12:
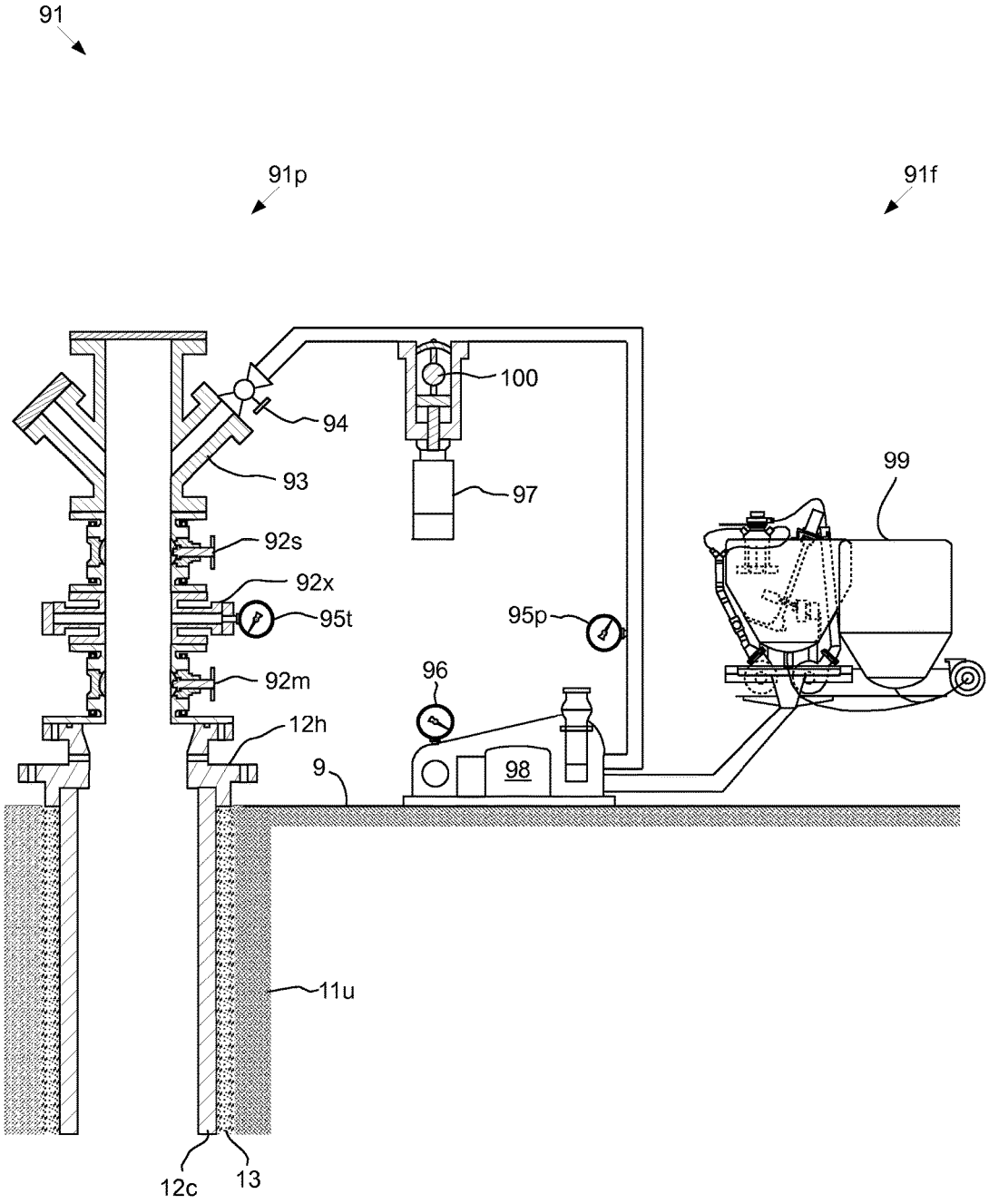
FIG. 12 illustrates a fracturing system.
Figures 13A, 13B, 13C, 13D, 13E:
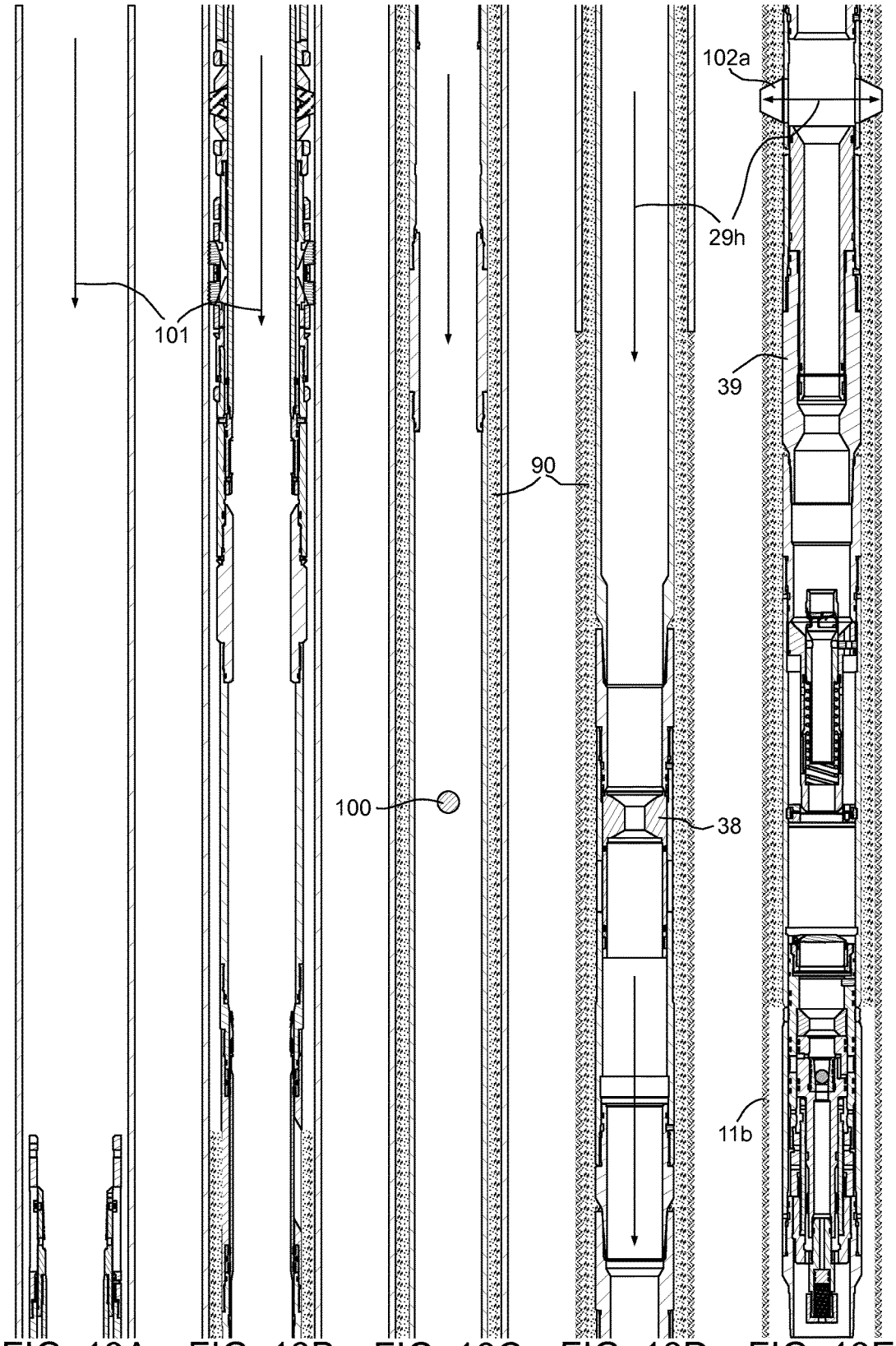
FIGS. 13A-13E illustrate opening of a toe sleeve of the liner string.

FIG. 12 illustrates a fracturing system 91. The fracturing system 91 may be delivered to the wellsite once the drilling system 1 has been dispatched from the wellsite. The cement slurry 29*s* may cure 90 as the drilling system 1 is dispatched from the wellsite and the fracturing system 91 is delivered to the wellsite. The fracturing system 91 may include a fluid system 91*f*, a production tree 91*p*, the fracture valve 38, and the toe sleeve 39. The production tree 91*p* may be installed on the wellhead 12*h*. The production tree 91*p* may include a master valve 92*m*, a flow cross 92*x*, and a swab valve 92*s*. Each component of the production tree 91*p* may be connected together and the production tree may be connected to the wellhead 12*h* and an injector head 93, such as by flanges and studs or bolts and nuts.

The fluid system 91*f* may include the injector head 93, a shutoff valve 94, one or more gauges, such as the pressure gauges 95*p,t* and a stroke counter 96, a launcher 97, a fracture pump 98, and a fracture fluid mixer, such as a recirculating mixer 99. The pressure gauge 95*t* may be connected to the flow cross 92*x* and may be operable to monitor wellhead pressure. The pressure gauge 95*p* may be connected between the fracture pump 98 and the valve 94 and may be operable to measure discharge pressure of the fracture pump. The stroke counter 96 may be operable to measure a flow rate of the fracture pump 98. A shifting plug 100, such as a ball, may be disposed in the launcher 97 for selective release and pumping downhole to open the fracture valve 38.

FIGS. 13A-13E illustrate opening of the toe sleeve 39. The fracture valve 38 may include a housing and a seat. The housing may be tubular, have a bore formed therethrough, and have threaded couplings formed at longitudinal ends thereof for connection to the adapter 37 and the toe sleeve 39. The housing may also have one or more fracture ports formed through a wall thereof for providing fluid communication between the housing bore and the annulus 10*a*. The housing may include two or more sections connected together, such as by threaded connections and fasteners, and the housing bore may be isolated from the annulus 10*a* by seals.

The seat of the fracture valve 38 may be disposed in the housing bore and be longitudinally movable relative thereto subject to engagement with upper and lower shoulders of the housing. The shoulders may be formed by longitudinal ends of the respective upper and lower housing sections. The seat may be releasably connected to the housing in a closed position (shown). The releasable connection may be a shearable fastener, such as a shear ring. The shear ring may have a stem portion disposed in a recess formed in an inner surface of the housing adjacent the upper shoulder and a lip portion extending into a groove formed in the outer surface of the seat. The seat may cover the fracture ports in the closed position and a seat-housing interface may be isolated from the annulus 10*a* by seals carried by the seat and straddling the fracture ports in the closed position.

Figures 14A, 14B, 14C, 14D, 14E:
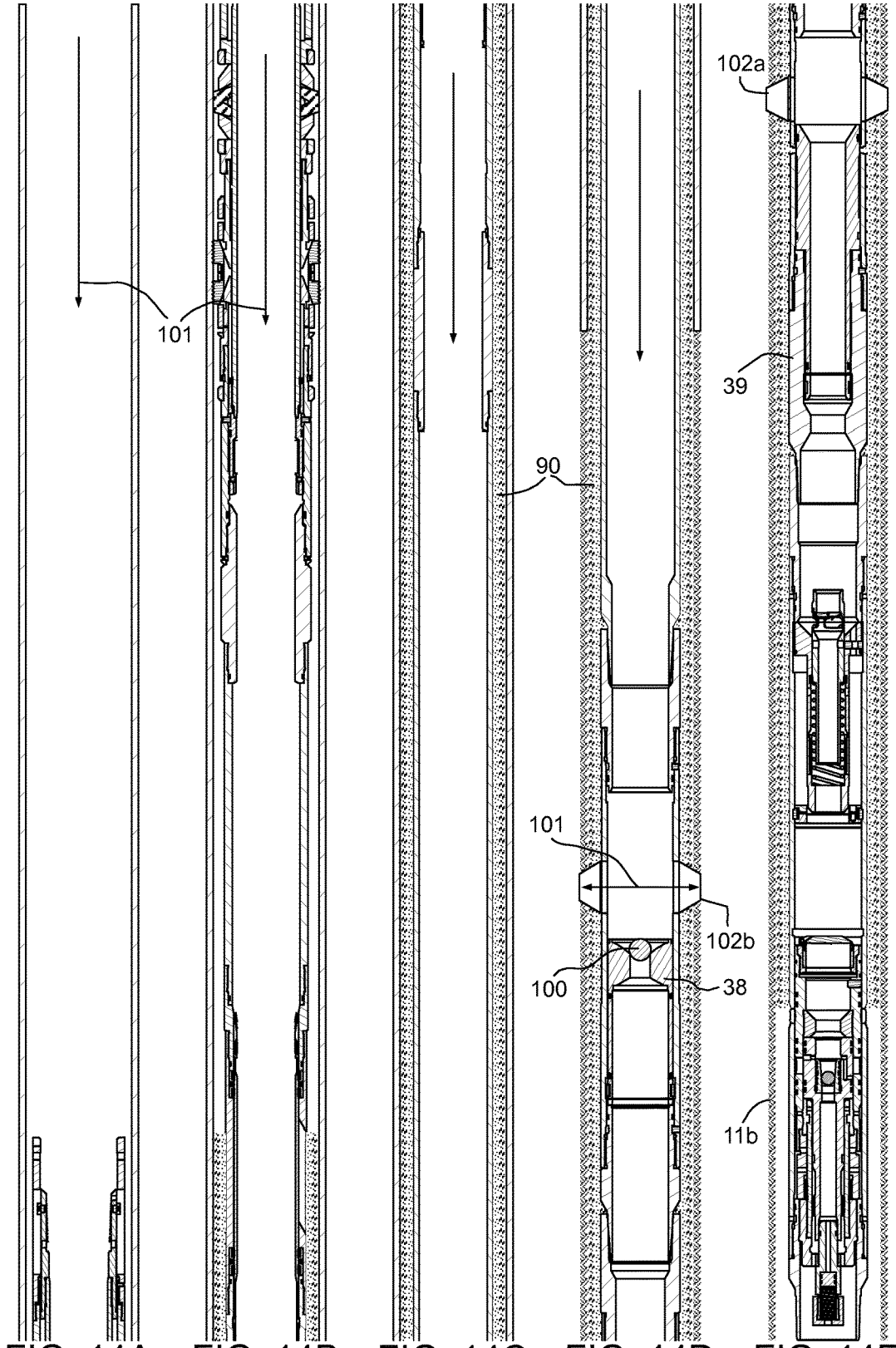
FIGS. 14A-14E illustrate fracturing a zone of the wellbore using a fracture valve of the liner string.

The seat of the fracture valve 38 may also carry a fastener, such as a snap ring, adjacent to a lower end thereof for engaging a complementary profile, such as a latch groove, formed in an inner surface of the housing adjacent the lower shoulder. Once released from the housing, the seat may move downward relative to the housing until a bottom of the seat engages the lower shoulder, thereby exposing the fracture ports to the housing bore (FIG. 14D). As the seat is nearing the open position, the snap ring may engage the latch groove, thereby locking the sleeve in the open position.

The toe sleeve 39 may include a housing and a piston. The housing may be tubular, have a bore formed therethrough, and have threaded couplings formed at longitudinal ends thereof for connection to the fracture valve 38 and the RCV 40. The housing may also have one or more flow ports formed through a wall thereof for providing fluid communication between the housing bore and the annulus 10*a*. The housing may include two or more sections connected together, such as by threaded connections and fasteners, and the housing bore may be isolated from the annulus 10*a* by seals.

The piston of the toe sleeve 39 may be disposed in the housing bore and be longitudinally movable relative thereto subject to engagement with upper and lower shoulders of the housing. The piston may be releasably connected to the housing in a closed position (FIG. 10E). The releasable connection may be a shearable fastener, such as one or more shear screws. The piston may cover the flow ports in the closed position and a piston-housing interface may be isolated from the annulus 10*a* by seals carried by the piston and straddling the flow ports in the closed position. The piston may also carry a fastener, such as a snap ring, adjacent to a lower end thereof for engaging a complementary profile, such as a latch groove, formed in an inner surface of the housing.

The toe sleeve 39 may have a hydraulic chamber may formed between the piston and the housing. The hydraulic chamber may be in fluid communication with the annulus 10*a* via the flow ports. The piston may have an enlarged inner shoulder exposed to the housing bore and an outer shoulder exposed to the hydraulic chamber. The piston may be operated by fluid pressure in the housing bore exceeding fluid pressure in the annulus 10*a* by a substantial differential sufficient to fracture the shear screws. Once released from the housing, the piston may move downward relative to the housing until a bottom of the piston engages the lower housing shoulder, thereby exposing the flow ports to the housing bore (shown). As the piston is nearing the open position, the snap ring may engage the latch groove, thereby locking the piston in the open position.

The shifting plug 100 may be released from the launcher 97 and fracturing fluid 101 may be pumped from the mixer 99 into the injector head 93 via the valve 94 by the fracture pump 98. The fracturing fluid 101 may be a slurry including: proppant (i.e., sand), water, and chemical additives. Pumping of the fracturing fluid 101 may increase pressure in the liner bore until the differential is sufficient to open the toe sleeve 39. Once the toe sleeve 39 has opened, continued pumping of the fracturing fluid 101 may force the chaser fluid 29*h* in the liner bore through the cured cement 90 and into the lower formation 11*b* by creating a first fracture 102*a*.

FIGS. 14A-14E illustrate fracturing a zone of the wellbore using a fracture valve of the liner string. The shifting plug 100 may travel down the liner bore toward the fracture valve 38 until the shifting plug lands onto the seat thereof. Continued pumping of the fracturing fluid 101 may exert pressure on the seated shifting plug 100 and the seat of the fracture valve 38 until the seat is released from the housing thereof by fracturing the shear ring. Continued pumping of the fracturing fluid 101 may move the shifting plug 100 and fracture valve seat downward relative to the housing of the fracture valve 38 until the seat is stopped by the lower shoulder of the housing and locked into place by the snap ring, thereby opening the fracture ports. Continued pumping of the fracturing fluid 101 may force the fracturing fluid through the cured cement 90 and into the lower formation 11*b* by creating a second fracture 102*b*. Proppant may be deposited into the second fracture 102*b* by the fracturing fluid 101.

Alternatively, as discussed above, the liner string 30 may have a second (or more) fracture valve for fracturing a second zone of the lower formation 11*b*. The second fracture valve may be assembled as part of the liner string 30 between the adapter 37 and the fracture valve 38. In this alternative, once a desired quantity of fracturing fluid 101 has been pumped, a second shifting plug having an outer diameter greater than the shifting plug 100 may then be launched and propelled down the liner bore by continued pumping of fracturing fluid until the second shifting plug lands in and opens the second fracture valve. This process may then be repeated for each additional fracture valve assembled as part of the liner string 30.

Once the fracturing operation has been completed, the injector head 93 may be removed from the tree 91*p*. The flow cross 92*x* may be connected to a disposal pit or tank (not shown) and fracturing fluid 101 allowed to flow from the wellbore 10*w* to the pit. A mill string (not shown) including coiled tubing and a bottomhole assembly (BHA) may be deployed into the wellbore 10*w* using a coiled tubing unit (CTU) (not shown). The CTU may include an injector, a reel of the coiled tubing, a tool housing, a stuffing box, one or more BOPs and a shutoff valve. The BHA may include a drilling motor and a mill bit. The injector may be operated to lower the coiled tubing and BHA into the wellbore 10*w* and a pump operated to inject milling fluid therethrough, thereby operating the motor to rotate the mill bit. A millable portion of the fracture valve 38 may be milled by the BHA. The BHA and coiled tubing may then be retrieved to the surface 9 and the CTU removed from the tree 91*p*. A production choke (not shown) may be connected to the flow cross 92*x* and to a separation, treatment, and storage facility (not shown). Production of the lower formation 11*b* may then commence.

Figures 15A, 15B:
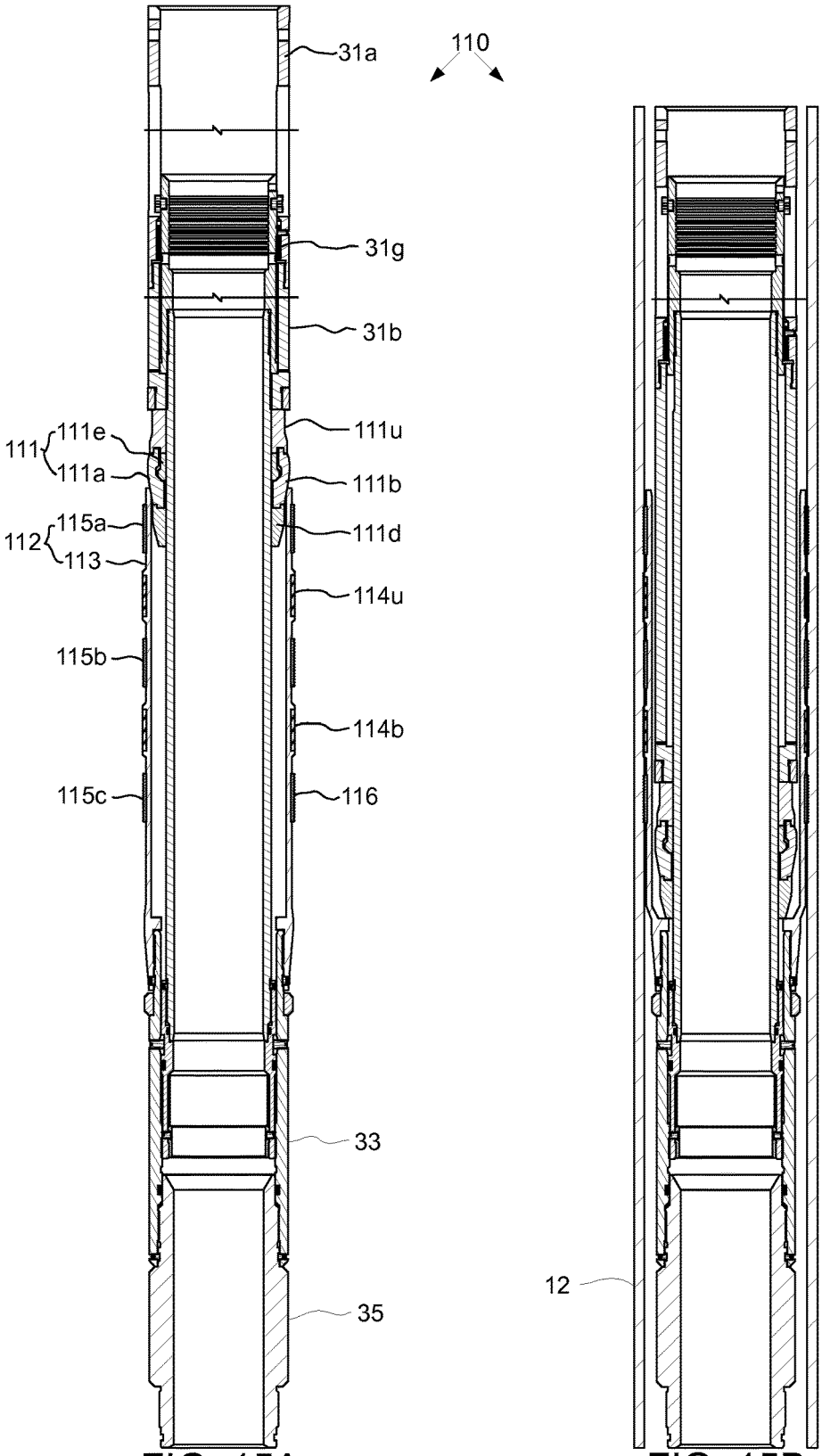
FIGS. 15A and 15B illustrate an alternative expansion system for use with the liner string, according to another embodiment of the present disclosure.

FIGS. 15A and 15B illustrate an alternative expansion system 110 for use with the liner string 30, according to another embodiment of the present disclosure. The expansion system 110 may replace the packer 31 and hanger 32. The expansion system 110 may include the setting sleeve 31*a,b*, the ratchet ring 31*g*, an expander 111, and an expandable liner hanger 112.

The expander 111 may include an upper cone retainer 111*u*, a set of cone segments 111*a,b*, a cone base 111*e*, and a lower cone retainer 111*d*. The expander 111 may be operable to radially and plastically expand the expandable hanger 112 into engagement with the casing string 12. The expander 111 may be driven through the expandable hanger 112 by the actuator 58. The cone segments 111*a,b* may each include a lip at each end thereof in engagement with respective lips formed at a bottom of the upper retainer 111*u* and a top of the lower retainer 111*d*, thereby radially keeping the cones. An inner surface of each cone segment 111*a,b* may be inclined for mating with an inclined outer surface of the cone base 111*e*, thereby holding each cone radially outward into engagement with the retainers.

The expandable liner hanger 112 may include a tubular body 113, one or more seals 114*u,b*, and one or more sets 115*a-c* of grippers 116. The body 113 may be made from a ductile metal or alloy. The seals 114*u,b* may be disposed in respective grooves formed in and along outer surface of the body in an alternating fashion with the gripper sets 115*a-c*. The seals 114*u,b* may be made from an elastomer or elastomeric copolymer. Each gripper 116 may be secured to an outer surface of the body 113 and may be made from a hard material, such as tool steel, ceramic, or cermet, for engaging and penetrating an inner surface of the casing 12, thereby anchoring the liner string 30 to the casing.

Figures 16A, 16B, 16C:
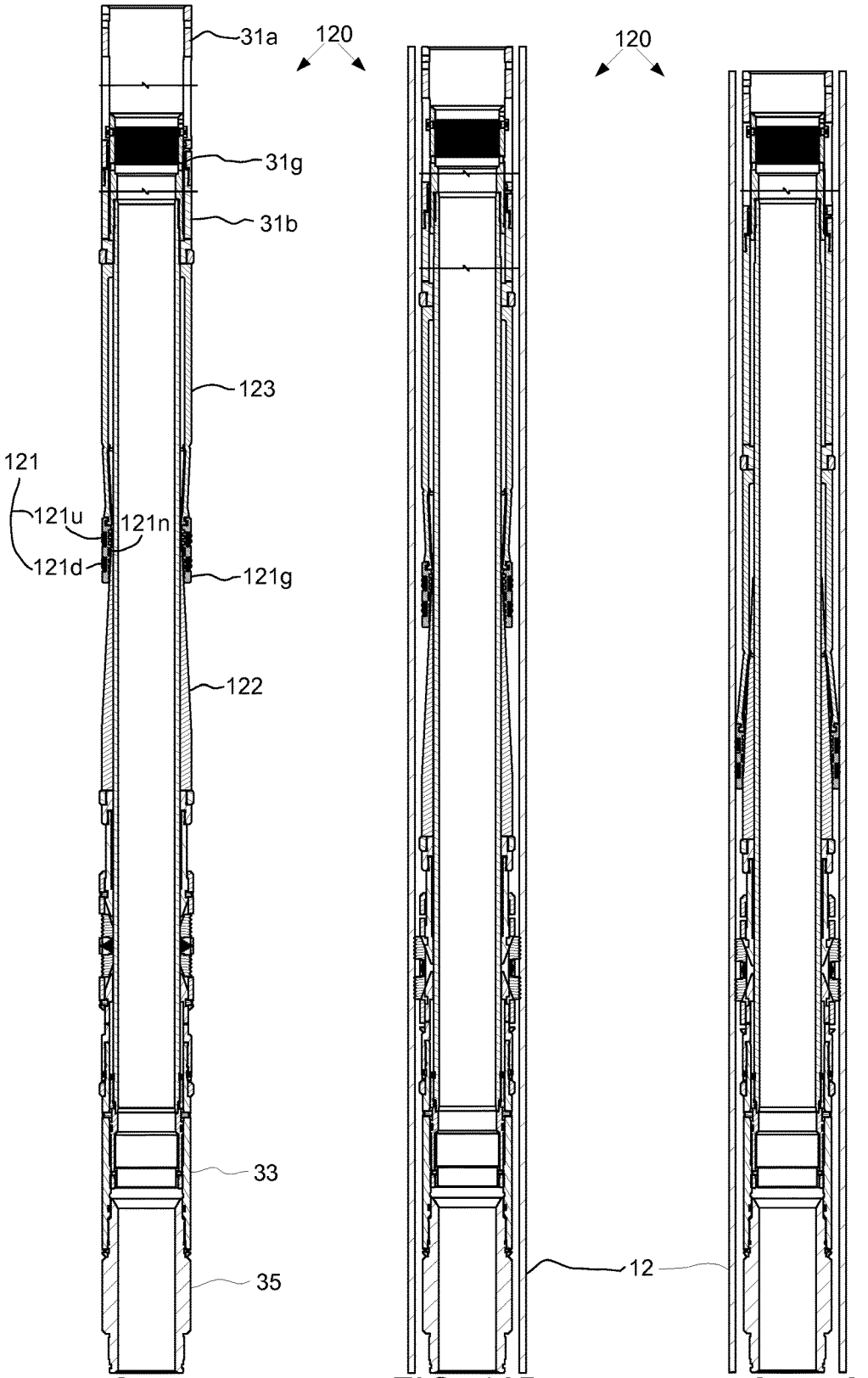
FIGS. 16A-16C illustrate an alternative packer for use with the liner string, according to another embodiment of the present disclosure.

FIGS. 16A-16C illustrate an alternative packer 120 for use with the liner string 30, according to another embodiment of the present disclosure. The alternative packer 120 may be replace the packer 31. The alternative packer 120 may include the setting sleeve 31*a,b*, the ratchet ring 31*g*, a packing element 121, a wedge 122, and a retaining sleeve 123. The packing element 121 may include a metallic gland 121*g*, an inner seal 121*n*, and one or more outer seals 121*u,d*. The gland 121*g* may have a groove formed in an outer surface thereof for receiving each outer seal. Each outer seal 121*u,d* may include a seal ring, such as an S-ring, and a pair of anti-extrusion elements, such as garter springs. The inner seal 121*n* may be an o-ring carried in a groove formed in an inner surface of the gland to isolate an interface formed between the gland 121*g* and the wedge 122.

The gland inner surface may be tapered having an inclination complementary to an outer surface of the wedge 122 and the gland 121*g* may be engaged with an upper tip of the wedge. The gland 121*g* may have cutouts formed in an inner surface thereof to facilitate expansion of the packing element 121 into engagement with the casing string 12 and a latch groove formed in the inner surface at an upper end thereof for receiving the retaining sleeve 123. The retaining sleeve 123 may have an upper base portion and collet fingers extending from the base portion to a lower end thereof. Each collet finger may have a lug formed at a lower end thereof engaged with the retaining sleeve latch groove, thereby fastening the retaining sleeve 123 to the packing element 121. The collet fingers may be cantilevered from the base portion and have a stiffness urging the lugs toward an engaged position with the latch groove.

The packing element 121 may be driven along the wedge 122 by the actuator 58. The setting force of the packer 120 may be substantially greater than the setting force of the liner hanger 32, such as greater than or equal to twice, four times, or eight times the hanger setting force. This ensures that the liner hanger 32 is set before the packing element 121 so that the set packing element is not pushed along the casing string 12 to accommodate setting of the hanger 32.

While the foregoing is directed to embodiments of the present disclosure, other and further embodiments of the disclosure may be devised without departing from the basic scope thereof, and the scope of the invention is determined by the claims that follow.

The invention claimed is:

1. A method of lining a wellbore having a tubular string cemented therein, comprising:

running a liner string into the wellbore using a workstring having a liner deployment assembly (LDA) latched to the liner string;

opening a port of a reverse cementing valve (RCV) located at a lower portion of the liner string;

closing a bore of the workstring;

hanging the liner string from the tubular string and setting a seal of the liner string against the tubular string;

opening a crossover valve of the liner string located below the set seal; and pumping cement slurry through the open crossover valve and down an annulus formed between the liner string and the wellbore, wherein the crossover valve is located at an upper portion of the liner string.

2. The method of claim 1, wherein:

closing the bore of the workstring forms a closure; and the liner string is hung and the seal is set by pressurizing the bore against the closure.

3. The method of claim 1, wherein:

closing the bore of the workstring forms a closure; and the workstring has a crossover port located above the closure, and the cement slurry is pumped down a bore of the workstring and through the crossover port to the open crossover valve.

4. The method of claim 2, wherein:

the RCV has a check valve propped open during running and hanging of the liner string, and the prop is released from the check valve in response to pumping of the cement slurry.

5. The method of claim 4, further comprising:

closing the crossover valve after pumping the cement slurry;

opening the bore after closing the crossover valve; and closing the RCV port by pressurizing the liner against the RCV check valve via the open bore.

6. The method of claim 1, wherein fluid displaced from the annulus by the cement slurry flows through the open RCV port, up the liner string, through a bypass passage of the LDA, and to an annulus formed between the workstring and the tubular string.

7. The method of claim 2, further comprising comprises releasing the liner string from the LDA by further pressuring the bore against the closure.

8. The method of claim 1, wherein the crossover valve is opened by:

raising the LDA relative to the liner string to engage a shifting tool of the LDA with a sleeve of the crossover valve; and lowering the LDA and engaged sleeve relative to the liner string.

9. The method of claim 8, further comprising disengaging the shifting tool from the open sleeve by further lowering the LDA relative to the liner string.

10. The method of claim 9, wherein a traveling valve of the LDA is shifted from a check position to an open position during lowering or further lowering of the LDA.

11. The method of claim 9, further comprising closing the crossover valve after pumping the cement slurry by:

raising the LDA relative to the liner string to reengage the shifting tool with the open sleeve; and raising the LDA and engaged sleeve relative to the liner string.

12. The method of claim 11, wherein:

the method further comprises disengaging the shifting tool from the closed sleeve by further raising the LDA relative to the liner string, the workstring has a crossover port located above the closure, the further raising is continued until the crossover port is adjacent to a top of the liner string, and the method further comprises pumping fluid down the bore and out of the crossover port to wash the workstring.

13. The method of claim 1, further comprising:

after curing of the cement slurry, opening a fracture valve of the liner string; and pumping fracturing fluid through the open fracture valve and the cured cement into a formation adjacent to the wellbore.

14. The method of claim 13, further comprising:

before opening the fracture valve, pressurizing the liner string to open a toe sleeve thereof, and the fracture valve is opened by pumping a shifting plug to the fracture valve.

15. The method of claim 1, wherein:

the liner string is hung by setting slips of a liner hanger, and the seal is an elastomeric packing element.

16. The method of claim 1, wherein the liner string is hung and the seal is set by driving an expander through an expandable liner hanger.

17. The method of claim 1, wherein:

the liner string is hung by setting slips of a liner hanger, and the seal is set by driving a metallic gland carrying an outer seal and an inner seal along a wedge.

18. A liner string for use in a wellbore, comprising:

a mandrel having a latch profile formed at an upper end thereof for engagement with a running tool;

a seal disposed along the mandrel;

a setting sleeve linked to the mandrel for engagement with a setting tool to set the seal;

a crossover valve for connection to a lower end of the mandrel; and a reverse cementing valve (RCV) for connection to the crossover valve.

19. The liner string of claim 18, further comprising a fracture valve having a seat for receiving a shifting plug and for connection between the crossover valve and the RCV.

20. The liner string of claim 19, further comprising a toe sleeve for connection between the fracture valve and the RCV.

21. The liner string of claim 18, further comprising:

a float collar for connection to the RCV; and a shoe for connection to the float collar.

22. The liner string of claim 18, further comprising a hanger disposed along the mandrel and having slips and a cone for extension of the slips into engagement with a casing string.

23. The liner string of claim 22, wherein the seal is an elastomeric packing element.

24. The liner string of claim 22, wherein:

the seal is a metallic gland carrying an outer seal and an inner seal, and the liner further comprises a wedge operable to expand the metallic gland.

25. The liner string of claim 18, wherein:

the seal is part of an expandable liner hanger, and the liner string further comprises an expander for expanding the liner hanger.

26. The liner string of claim 18, wherein the RCV comprises:

a tubular housing having a port formed through a wall thereof;

an outer port valve disposed in the housing for selectively opening and closing the port;

an inner port valve disposed in the housing for selectively opening and closing the port and having a seat for receiving a shifting plug;

a bore valve disposed in the housing for selectively opening and closing a bore of the RCV;

a check valve disposed in the housing and operable to close the outer port valve and the bore valve in response to fluid injected through the RCV bore; and a prop valve for retaining the check valve in an open position and operable to release the check valve in response to fluid injected through the port.

27. The liner string of claim 18, wherein the reverse cementing valve (RCV) is located at a lower portion of the liner string.

28. A system for use in a wellbore, comprising:

the liner string of claim 18; and a liner deployment assembly (LDA), comprising:

the setting tool for connection to a workstring and operable to set the seal;

the running tool for connection to the setting tool and having a latch for engagement with the latch profile;

a crossover sub for connection to the running tool and having a port for alignment with the crossover valve and a bypass passage;

a valve for connection to the crossover sub and for selectively closing a bore of the LDA to operate the setting tool; and a shifting tool for connection to the LDA valve and for opening and closing the crossover valve.

29. The system of claim 28, wherein the LDA valve comprises a seat for receiving a setting plug to close the LDA bore and operate the setting tool.

30. The system of claim 28, wherein the shifting tool is part of a traveling valve operable between a check position and an open position.

* * * * *